US008302890B2

(12) United States Patent
Lewis-Gray

(10) Patent No.: US 8,302,890 B2
(45) Date of Patent: Nov. 6, 2012

(54) MODULAR ORE PROCESSOR

(75) Inventor: Alexander Hamilton Lewis-Gray, Ballarat (AU)

(73) Assignee: Gekko Systems Pty Ltd., Ballarat (AU)

( * ) Notice: Subject to any disclaimer, the term of this patent is extended or adjusted under 35 U.S.C. 154(b) by 258 days.

(21) Appl. No.: 12/679,999

(22) PCT Filed: Sep. 5, 2008

(86) PCT No.: PCT/AU2008/001313

§ 371 (c)(1),
(2), (4) Date: Apr. 8, 2010

(87) PCT Pub. No.: WO2009/039559

PCT Pub. Date: Apr. 2, 2009

(65) Prior Publication Data

US 2010/0193618 A1 Aug. 5, 2010

(30) Foreign Application Priority Data

Sep. 26, 2007 (AU) ..... 2007905245

(51) Int. Cl.
*B02C 21/02* (2006.01)

(52) U.S. Cl. ..... 241/30; 241/79; 241/79.1; 241/101.71; 241/285.1

(58) Field of Classification Search ..... 241/285.1, 241/285.2, 101.71, 79, 79.1, 30
See application file for complete search history.

(56) References Cited

U.S. PATENT DOCUMENTS

| | | | |
|---|---|---|---|
| 3,098,818 | A | 7/1963 | Daman et al. |
| 3,446,349 | A | 5/1969 | Benzon |
| 3,498,674 | A | 3/1970 | Matthews |
| 4,285,548 | A | 8/1981 | Erickson |
| 4,505,811 | A | 3/1985 | Griffiths et al. |
| 5,167,798 | A | 12/1992 | Yoon et al. |
| 5,522,510 | A | 6/1996 | Lutrell et al. |
| 6,613,271 | B1 | 9/2003 | Lewis-Gray |

FOREIGN PATENT DOCUMENTS

| | | |
|---|---|---|
| GB | 530890 | 12/1940 |
| JP | 07259467 | 10/1995 |
| WO | 9915276 | 4/1999 |

*Primary Examiner* — Mark Rosenbaum
(74) *Attorney, Agent, or Firm* — Volpe and Koenig, P.C.

(57) ABSTRACT

A modular ore processing system for concentrating ores includes a plurality of separate modules constructed so as to be serially arranged to form a feed processing system for concentrating a desired material in the ore, wherein the modules are individually transportable to a processing site to be operationally coupled to form the modular ore processing system.

37 Claims, 30 Drawing Sheets

MODULAR ORE PROCESSOR

FIELD OF THE INVENTION

This invention relates to a modular processing system for feeds such as ores. It relates particularly but not exclusively to a modular ore processing system which may be used in underground drives of mines so as to concentrate ores before they need to be taken to the surface. It also relates to individual modules comprising the modular processing system.

BACKGROUND OF THE INVENTION

Ore bodies are typically processed by mining the ore body and transporting the mined ore to a processing plant. After concentration and further processing of the ore, there is often a large volume of waste material such as tailings which remain to be disposed of in an environmentally acceptable manner. Thus, there are two particular areas in which the mining and processing of ores may be improved, namely, the reduction in the amount of transport required to deliver the ore from the mine site to the processing facility and the provision of a suitable means of disposing of the wastes.

Both of these improvements can be achieved by having a processing facility which is transportable so that it can be moved as required so that it will always be located relatively near to the site where the ore is being mined. By locating the treatment facility near the mining site, those areas of the mine site which have already been dug out may provide a ready dump for the waste material.

Bearing in mind that many mine sites are underground, it would be highly desirable for the processing facility to be dimensioned so that it can be readily transported underground to be located close to where ore is being mined, e.g. in the underground drive of a mine.

Overall, some of the potential benefits of underground processing are identified as follows:—

- step change reduction in ore transport costs;
- possible reduction in material losses due to repeated handling and transportation operations;
- noise suppression;
- reduced surface dust;
- reduced operating costs;
- reduction in total capital costs when transport systems and processing systems are assessed as a whole;
- reduced demand for ore and waste haulage capacity;
- increase in mine output. (Note: many mines have limitations imposed by the current capacity of the shafts or declines that exist—underground concentration of feed should help to alleviate such bottlenecks).

The benefits of such a system may be particularly marked in relation to where the ore body can be greatly pre-concentrated. This is the case in the gold sector and is particularly applicable where the mining of the ore body is heading towards a depth of 500 metres and beyond.

DISCLOSURE OF THE INVENTION

The invention provides in one aspect a modular ore processing system for concentrating ores comprising,

- a plurality of separate modules constructed so as to be serially arranged to form a feed processing system for concentrating a desired material in the ore, wherein the modules are individually transportable to a processing site to be operationally coupled to form the modular ore processing system.

The plurality of separate modules may comprise a module for crushing the ore, a module for sizing the ore and a module for concentrating the ore.

The desired material may typically be a valuable ore (eg. copper ore) gems (eg. diamonds) or metal (eg. gold).

The modules may be dimensioned so that they may be located in a tunnel. The tunnel may comprise an underground drive of a mine. Typically a drive may be of generally rectangular cross-section with a height of about 5 metres and a width of about 5 metres. Thus the dimensions of each module may be such that they may fit in an underground drive.

The modules may be constructed in such a way as that their dimensions can be varied to suit the circumstance of use. For example, the height, length or width of an module may be reduced or "concertinaed" during transport through a mine only to be expanded or reconfigured to operating size when put in place.

A module when set up for operating in an ore processing system may have a width between 1.5 and 5 metres, a height less than 5 metres and a length less than 11 metres. Typically a module may have a width of 1.8 metres to 3.5 metres and a length of 5 to 10 metres.

A typical module may be constructed on a skid. A typical skid width is about 2.5 metres and length about 8.5 metres. It may be provided with opposed ends one of which forms a projection and the other a recess or socket so that adjacent modules may be nested end to end.

A typical processing system for concentrating ore, especially gold containing ore, or other feed containing valuable materials, may comprise five or more modules. Preferably the feed will be concentrated by at least a volume factor of 2 more preferably a factor of 3 ie. the volume of concentrate will be ½ or less than that of the original feed.

In one example, a system of seven modules in order, may comprise, a feeder module first. The feeder module may separate oversized ore for further breaking up. It may deliver undersized ore via a conveyor to the second module.

The second module may comprise a primary crushing module. The second module may perform a primary crush on the ore from the first module. It may comprise a jaw crusher or hammer mill. It may also receive and re-crush oversize crushed ore from a later module. It may direct primary crushed ore to a third module. It may comprise a primary crush conveyor for directing primary crushed ore to the third module. It may include a transfer assembly for transferring primary crushed ore from the an outlet of the crushing device to the primary crush conveyor. The transfer assembly may comprise a vibrating platform arranged beneath the outlet of the crusher so as to convey primary crushed ore to the primary crush conveyor.

The third module may be a crushing and screening module. It may screen primary crushed ore from the second module. It may return oversize ore to the second module for further crushing. It may direct undersize ore to a fourth module. It may comprise a third module conveyor. The third module conveyor may be arranged to receive primary crushed ore after it has passed through an initial screen on the third module. The initial screen may be a vibrating screen. It may be arranged to direct oversize primary crushed ore to the second module. It may allow initially screened ore to fall directly on to the third module conveyor. A secondary crusher may be located on the third module. It may be arranged to crush feed received from a fourth module. The secondary crusher may comprise a hammer mill vertical shaft impactor or high pressure grinding rolls. The secondary crushed feed may be directed onto the third module conveyor. A third module vibratory feeder may convey the secondary crushed feed ore from the secondary crusher onto the third module conveyor.

The fourth module may comprise a conveyor module. The conveyor module may comprise receiver and return conveyors. The receiver conveyor may be arranged to receive crushed feed ore from the third module conveyor so as to convey it to a fifth module. The return conveyor may be arranged to receive screened ore from the fifth module and to convey it to the secondary crusher. At least one of the receiver and return conveyors may include a reconfiguration assembly to raise and lower the receiver or return conveyor. The reconfiguration assembly may comprise an hydraulic or pneumatic cylinder supporting the conveyor.

The fifth module may comprise a secondary screening module. It may comprise a secondary screen arranged to receive feed ore from the receiver conveyor. The secondary screen may be a vibrating screen. It may comprise water spray for spraying water onto the feed ore. It may comprise a slurry hopper for receiving and holding a primary slurry of the undersize feed ore and water. It may comprise a flow assembly for directing the primary slurry to a sixth module. The flow assembly may comprise a pipe connected to the slurry hopper for a pump. The fifth module may comprise a coarse ore bin for receiving oversize and vibratory feeder to direct the oversize onto a fifth module conveyor. It may be arranged to receive oversize feed ore from the secondary screen.

The fifth module may comprise a tertiary screen. The tertiary screen may be a static or vibrating screen. The tertiary screen may be arranged to receive a slurry feed from the sixth module. The tertiary screen may comprise a chute to direct oversize to a coarse ore bin and pipework for directing undersize feed to the sixth module in the form of a slurry. A vibratory feeder may be arranged to convey feed from the coarse ore hopper onto the fifth module conveyor. The undersize slurry feed may be directed to a sixth module.

The sixth module may comprise a concentration module. It may comprise at least one feed concentration device. At least one feed concentration device may comprise a concentration device (eg. jig) of the type described and claimed in U.S. Pat. No. 6,079,567. It may comprise two jigs. The jigs may be arranged in series or parallel. The first jig of a series may receive the primary slurry. It may be arranged so as to direct tailings to the tertiary screen and concentrate to the second jig. The second jig may be arranged to direct tailings to the secondary screen. The final concentrate from the second jig may be harvested as one of the products of the ore processing system.

The seventh module may comprise a recycle module. The module may comprise a hydrocyclone for separating the solids from the undersize of the tertiary screen into water and tailings. The seventh module may comprise a tank for recycling water. The tank may comprise a separation assembly for separating solids from water. The separation assembly may comprise a baffle provided in the tank. The baffle may compartmentalize the tank into a sludge compartment and an overflow water compartment arranged to receive overflow water from the sludge compartment. The overflow water may be re-used in the process in the separating devices and screens. The module may comprise a hydrocyclone for separating the solids from the undersize of the tertiary screen into water and tailings.

There may be an eight module. It may comprise a control module. The control module may house the controls for the other modules.

There may be an optional fines separation module. It may be interposed between the sixth and seventh module. It may receive tailings from the sixth module. It may comprise a flotation cell arranged to receive the tailings. It may comprise a centrifugal concentrator. The centrifugal concentrator may be arranged to receive the underflow from the flotation cell.

Whilst the foregoing summary of different modules has described them as being in a particular order increasing numerically, it is to be appreciated that the order of the modules may be re-arranged to suit particular circumstances. This can apply particularly for the control module, and any module which deals solely with pumpable materials ie. slurry, sludge and water. Thus the concentration, fines separation and recycle module may be readily changed in order.

The invention also covers the individual modules making up the modular processing system of the invention.

One or more of the modules may include additional features such as adjustable legs for correctly levelling the modules on uneven ground.

Another additional feature may be provision for assisting sliding of the modules along the ground. This may take the form of skid plates provided on the base of a skid. Typically, two skid plates may be provided proximate the opposite ends of the skid.

Additionally or alternatively, the modules may include provision for wheels which may optionally be removable when the modules have been moved into place.

The dimensions of the modules may be adjustable for transport. For example, one or more of the modules may include means for raising and lowering portions of the module during and after transport into a mine.

In another aspect the invention also covers a method of mining feeds such as ores underground which comprises concentrating the feed underground to less than a half of its original volume before bringing it above ground. The tailings may then be dumped in a dug out portion of the mine.

DETAILED DESCRIPTION OF THE DRAWINGS

Figure 1:
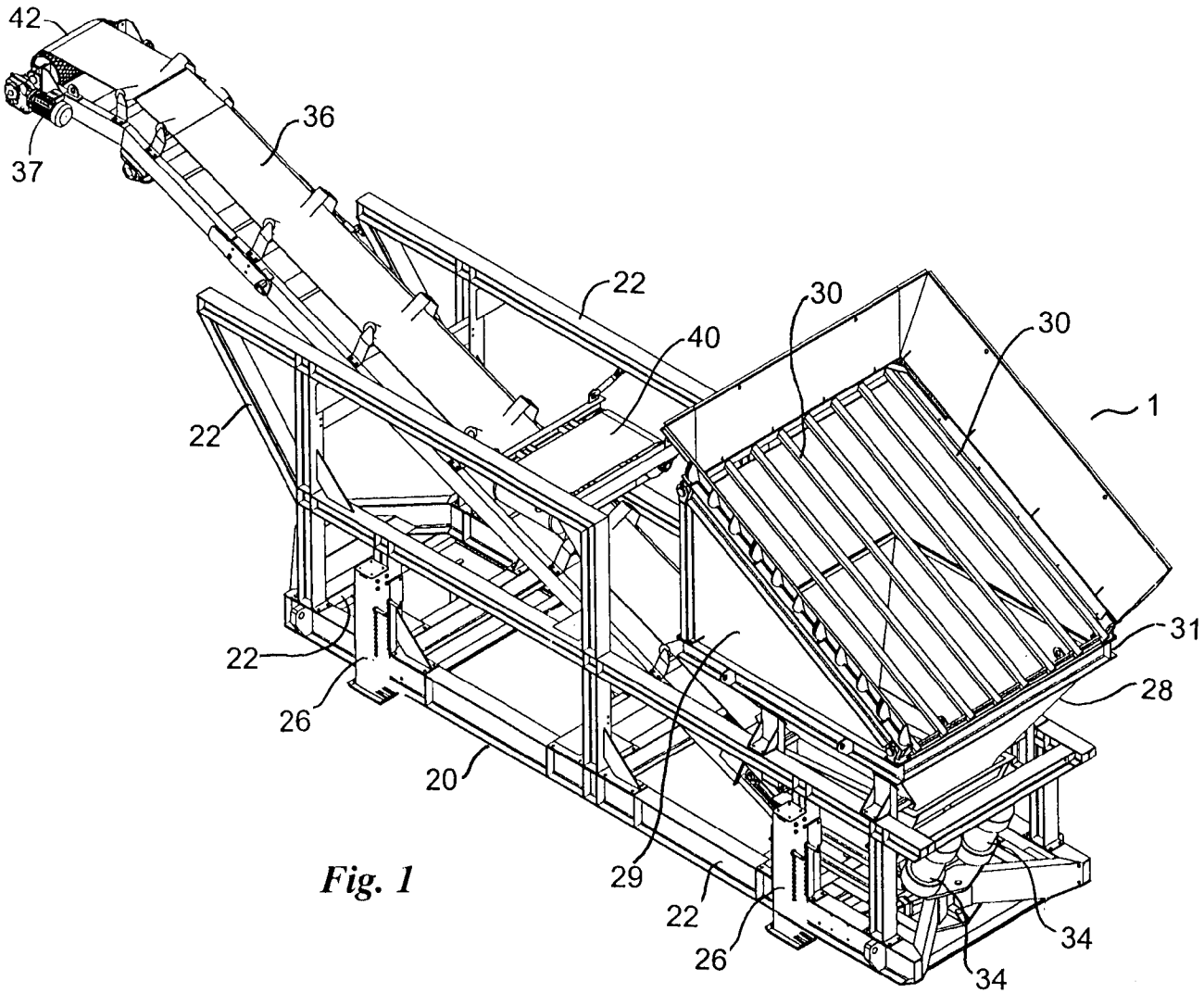
FIG. 1 is a perspective view of a feeder module according to the invention.

The various elements identified by numerals in the drawings are listed in the following integer list.

| Integer List | |
|---|---|
| 1 | Feeder module |
| 2 | Primary crushing module |
| 3 | Crushing and screening module |
| 4 | Conveyor module |
| 5 | Secondary screening module |
| 6 | Concentration module |
| 6a | Fines separation module |
| 7 | Recycle module |
| 8 | Control module |
| 20 | Skid |
| 22 | Steel beams |
| 24 | Skid plate |
| 25 | Projecting end |
| 26 | Hydraulic post |
| 27 | Locking pin hole |
| 28 | Bin |
| 29 | Grill assembly |
| 30 | Bar |
| 31 | Base |
| 32 | Feeder |
| 33 | Feeder floor |
| 34 | Vibratory motor |
| 36 | Conveyor |
| 37 | Motor |
| 38 | Tension adjustment |
| 40 | Magnet |
| 42 | Delivery end |
| 50 | Skid |
| 51 | Electrical box |
| 52 | Socket end |
| 53 | Locking pin hole |
| 54 | Projecting end |
| 56 | Crusher (jaw crusher) |
| 58 | Mouth/chute |
| 60 | Chain wall |
| 62 | Motor |
| 64 | Flywheel |
| 66 | Support frame |
| 67 | Rib |
| 68 | Vibratory motor |

-continued

| Integer List | |
|---|---|
| 70 | Feeder floor |
| 71 | Slidable bar |
| 72 | Conveyor |
| 74 | Delivery end |
| 76 | Motor |
| 78 | Return conveyor |
| 79 | Motor |
| 80 | Chute |
| 90 | Skid |
| 92 | Socket end |
| 94 | Projecting end |
| 96 | Screen assembly |
| 98 | Screen |
| 100 | Motor |
| 102 | Belt drive |
| 104 | Eccentric shaft |
| 106 | Lip |
| 108 | Screen body |
| 109 | Chute |
| 110 | Conveyor |
| 112 | Motor |
| 114 | Delivery end |
| 116 | Secondary crusher/vertical shaft impactor |
| 118 | Inlet |
| 120 | Vibratory motor |
| 122 | Vibratory feeder |
| 129 | Projecting end |
| 130 | Skid |
| 131 | Socket end |
| 132 | Receiver conveyor |
| 133 | Motor |
| 134 | Chute |
| 136 | Delivery end |
| 138 | Magnet |
| 140 | Return conveyor |
| 141 | Motor |
| 142 | Chute |
| 144 | Delivery end |
| 146 | Metal detector |
| 148 | Hydraulic ram |
| 150 | Air compressor |
| 160 | Skid |
| 162 | Vibrating screen assembly |
| 164 | Screen |
| 166 | Chute |
| 168 | Water spray bar |
| 170 | Undersize hopper |
| 172 | Slurry pump |
| 174 | Slurry pipe |
| 178 | Water service pipe |
| 180 | Pipe |
| 182 | Return conveyor |
| 184 | Delivery end |
| 186 | Static screen assembly |
| 187 | Screen undersize hopper |
| 188 | Pipe |
| 190 | Coarse ore bin |
| 192 | Vibrating feeder floor |
| 194 | Vibratory motor |
| 200 | Skid |
| 202 | Pressure jig |
| 204 | Pressure jig |
| 208 | Air bleed pipe |
| 210 | Air bleed pipe |
| 212 | Air bleed pipe |
| 213 | Return pipe |
| 218 | Pipe |
| 222 | Pipe |
| 223 | Pipe |
| 224 | Pipe |
| 228 | Pump |
| 230 | Pump |
| 232 | Pump |
| 234 | Pump |
| 240 | Skid |
| 242 | Centrifugal concentrator |
| 244 | Flotation cell |
| 248 | Pump |

-continued

| Integer List | |
|---|---|
| 249 | Pipe |
| 252 | Pipe |
| 254 | Pump |
| 256 | Pipe |
| 258 | Final concentrate pipe |
| 259 | Final concentrate pipe (joins 258) |
| 260 | Hydraulic cylinder |
| 261 | Axle |
| 262 | Axle |
| 280 | Skid |
| 282 | Tank |
| 284 | Baffle |
| 286 | Sludge compartment |
| 288 | Overflow water compartment |
| 290 | Level sensor |
| 292 | Level sensor |
| 294 | Pump for process water |
| 296 | Tails hopper |
| 299 | Cyclone overflow pipe |
| 300 | Cyclone |
| 302 | Tank overflow pipe |
| 304 | Desludge pipe |
| 305 | Pipe |
| 306 | Tails pump (to waste or flotation) |
| 308 | Hydraulic cylinder |
| 310 | Skid |
| 312 | Housing |
| 314 | Ore |
| 316 | Oversize ore |

Referring to FIGS. 1 to 3 and 23, there is shown a feeder module generally designated 1. The feeder module will have a similar footprint to all of the other modules which will be described hereinafter. It will also be constructed on a skid along similar lines to those of the succeeding modules.

As with all modules, the feeder module will comprise a skid 20 made up of a framework of steel beams 22. The framework is such that the skid will fit within a 2 m×7.5 m long envelope. Given that a standard underground drive is 5 m×5 m, the maximum height of the operating items on a skid will generally be less than 5 m when in use.

The module includes skid plates 24 proximate to its two ends and has a projecting end 25 adapted to loosely fit within the socket end 26 of an adjacent module.

The skid may optionally be provided with removable wheels (not shown) which facilitate transport of the module for installation.

Four hydraulic posts 26 are provided for levelling of the module when in position.

The projecting end is provided with a locking pin hole 27 for locking the projecting end of the module to the next module in the series.

A bin 28 is provided at the forward end of the module and a grill assembly 29 with spaced bars 30 is mounted on the bin.

Figure 2:
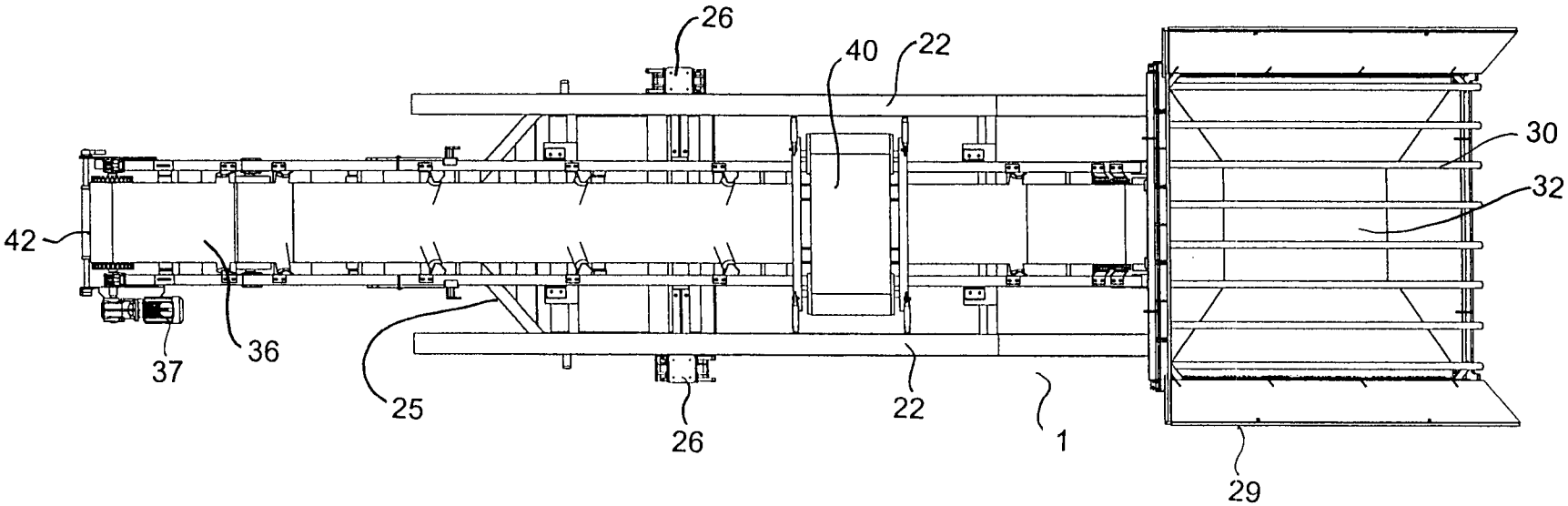
FIG. 2 is a plan view of the feeder module of FIG. 1.
Figure 3:
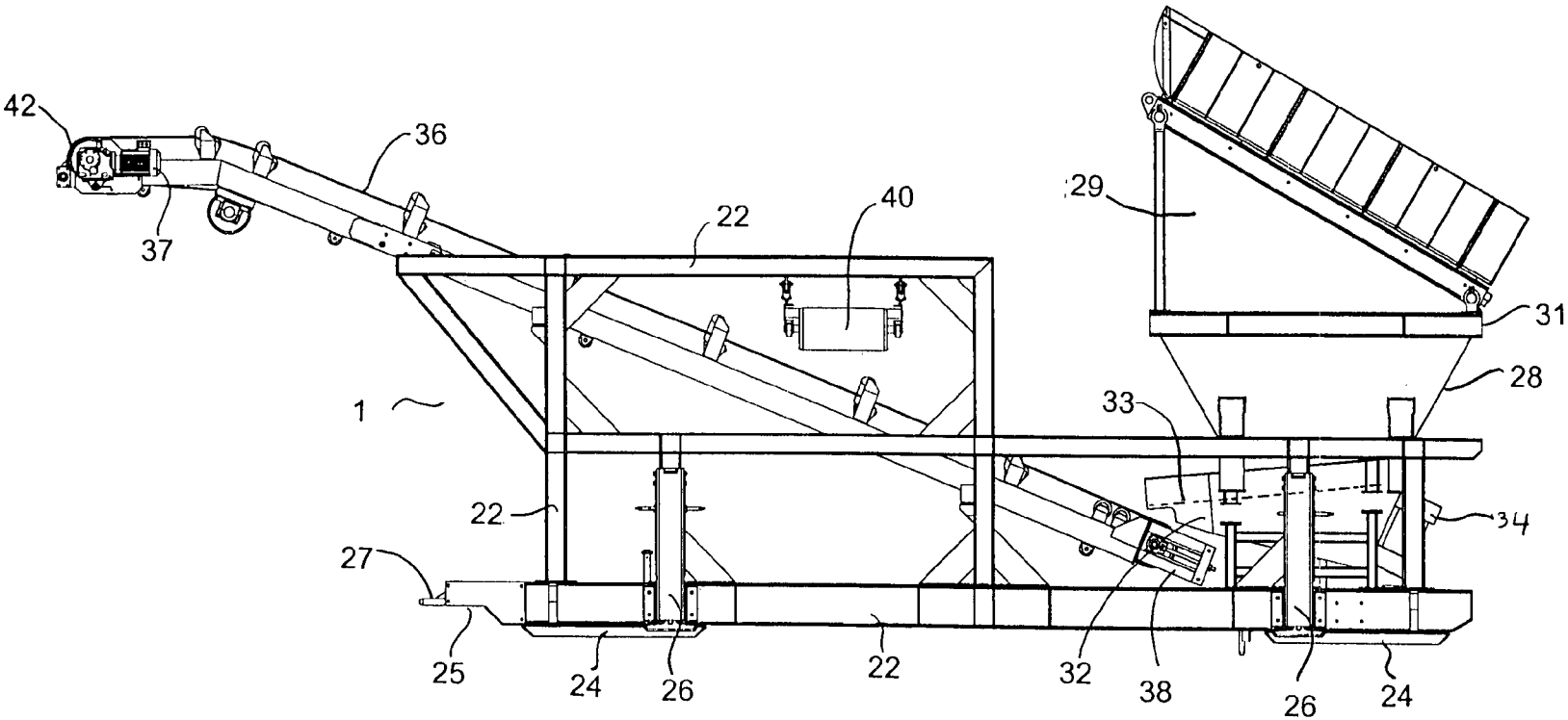
FIG. 3 is an elevational view of the feeder module of FIG. 1.

The base 31 of the grill assembly is constructed so as to neatly fit onto the top of the bin 28 in such a fashion that the orientation of the grill assembly may be changed to suit a particular need. For example, whilst the grill assembly shown in FIGS. 1 to 3 is arranged so as to receive ore in a direction in line with the length of the module, it is to be appreciated that the grill assembly can be lifted and rotated 90° in either direction so that it can receive ore in a direction perpendicular to the module.

The bars of the grill assembly extend at an angle to the horizontal so that any ore which is oversize will drop onto the ground behind or next to the module so that it can be picked up for breaking down before it is returned for processing.

The bin 28 is arranged so that ore falling through the grill assembly falls onto the feeder floor 33 of the feeder 32.

The feeder floor is vibrated by the motors 34 so that material falling through the bin 28 is directed onto the conveyor 36. By having a vibratory feeder arrangement of this sort, it has been found that the height of the bin 28 and grill assembly 29 can be kept within the 5 metre limit required for operation in a standard underground drive.

The conveyor 36 is powered by the motor 37 and includes a tension adjustment 38 as is known in the art.

A magnet 40 is arranged at a position immediately above and intermediate the length of the conveyor to pick up metal items which have become entrained in the feed.

The delivery end 42 of the conveyor 36 extends beyond the end of the skid to an elevated position where it can deliver the feed to the next module.

Figure 4:
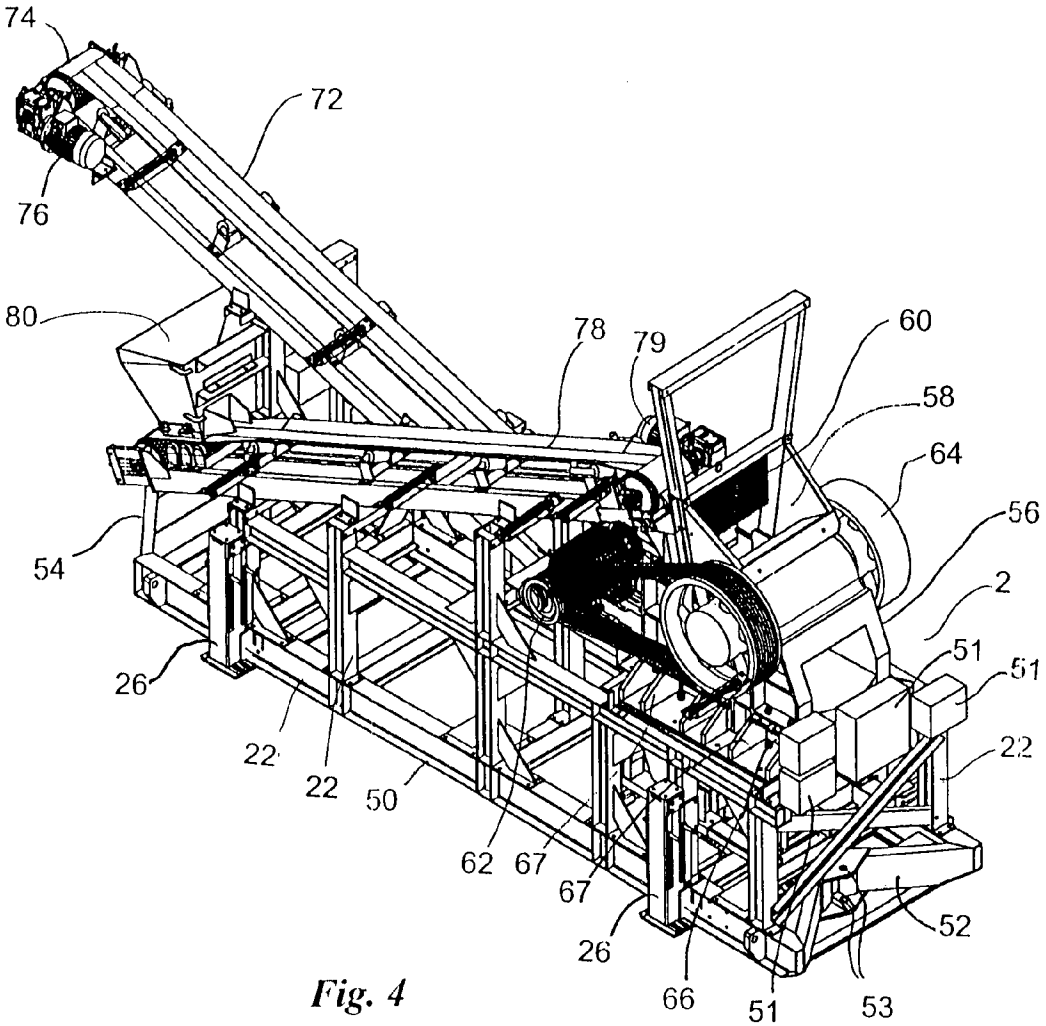
FIG. 4 is a perspective view of a primary crushing module according to the invention.
Figure 5:
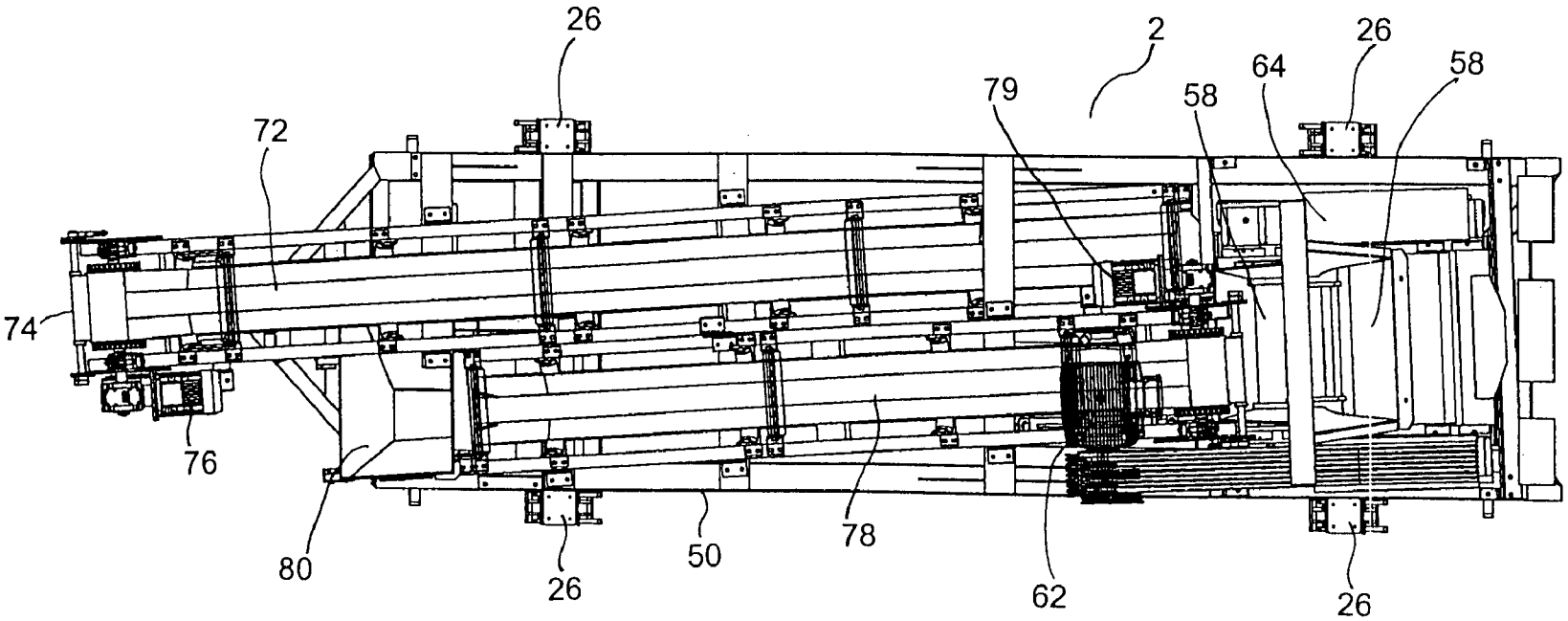
FIG. 5 is a plan view of the primary crushing module of FIG. 4
Figure 6:
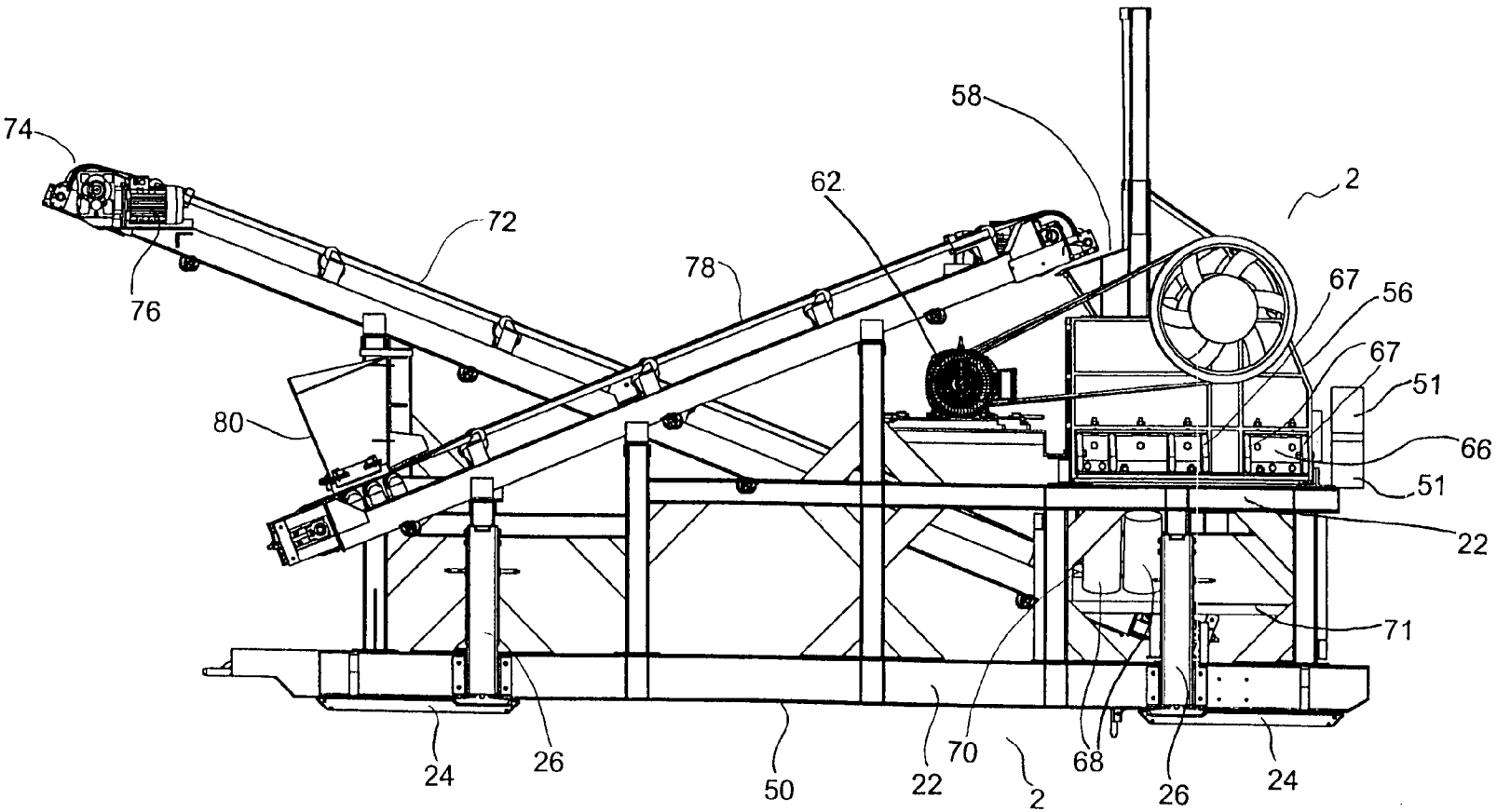
FIG. 6 is an elevational view of the primary crushing module of FIG. 4.
Figure 24:
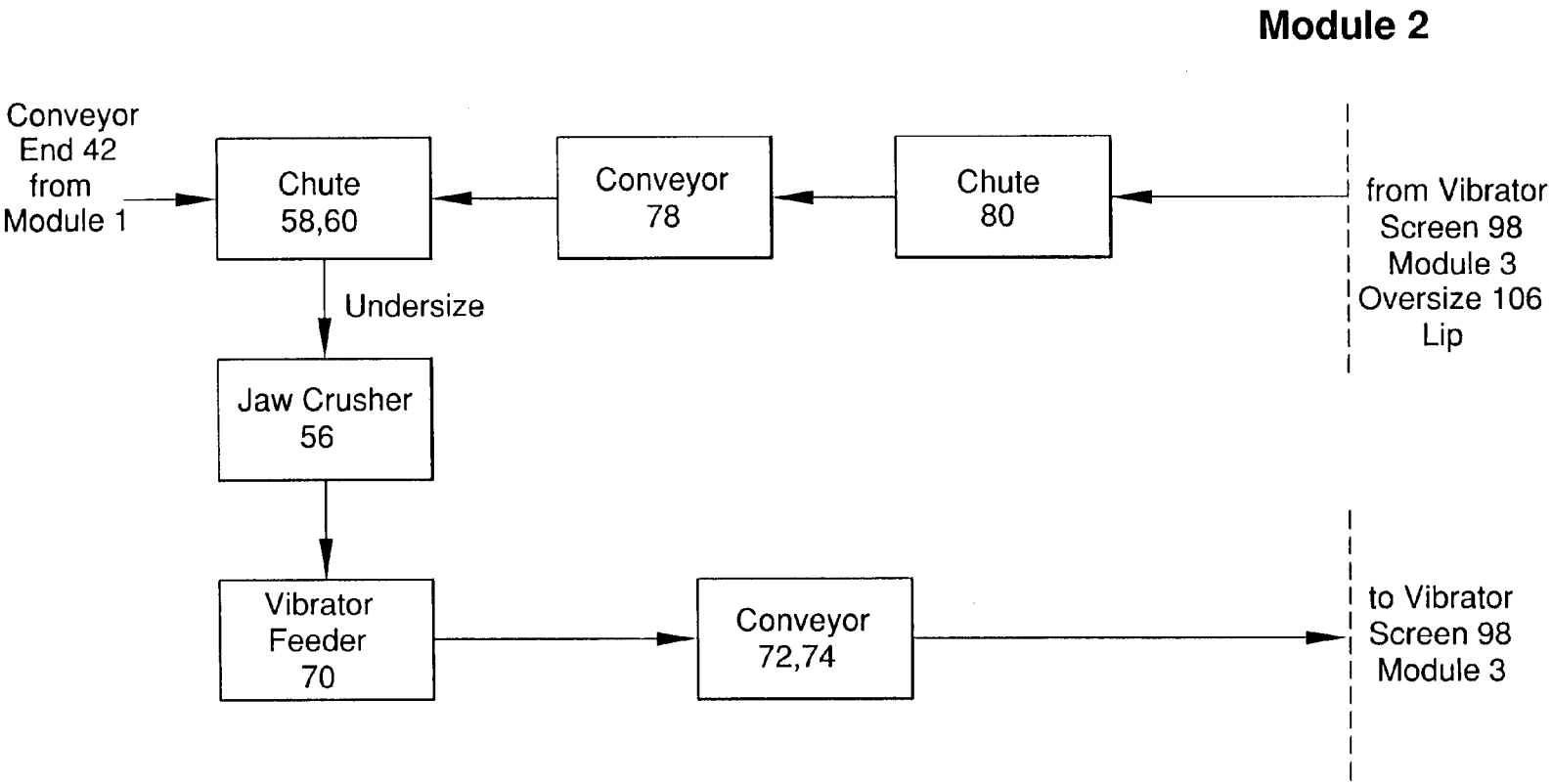
FIG. 24 is a schematic view of the primary crushing module.

Referring to FIGS. 4, 5 and 24, the primary crushing module generally designated 2 is built on skid 50. It is located in line with and abutting the feeder module with the socket end 52 of the skid 50 receiving the projecting end 25 so that a locking pin may be passed through the locking pin holes 53 and 27 to join the two modules together.

The opposite end is also provided with a projecting end 54 as was the case with the previous module so that it can be joined to the next module and so on.

A number of electrical boxes 51 are provided for controlling the operation of module 2 are located at the receiving end of the module.

The module 2 includes a crusher 56. Typically, the crusher will be a jaw crusher, although it is to be appreciated that other forms of crushing equipment as are known in the art may be used. The jaw crusher may typically be set at a closed side setting less than 100 mm, more preferably less than 50 mm.

The crusher has a mouth or chute 58 arranged so as to receive feed from the delivery end 42 of the conveyor 36.

A chain wall 60 is provided so as to divide the upper part of the mouth 58 of the crusher into a forward and rear portion and to direct the feed into the crusher. This also prevents feed flowing into the forward end of the mouth crashing into the feed coming in from the opposite direction on conveyor 78.

A motor 62 drives the jaw crusher via the flywheel 64.

The jaw crusher is mounted on a support frame 66 and is provided with lateral ribs 67 for rigidity. The support frame is in turn mounted on the steel beams 22 forming the frame of the skid. It has been found that this type of mounting structure helps to reduce the overall height of the jaw crusher on the skid.

A feeder floor 70 is arranged beneath the crusher. It receives feed passing through and being crushed by the crusher 56 and is vibrated by vibratory motors 68. The sloping vibrating floor directs the feed onto the conveyor 72.

A slidable bar 71 for moving the feeder floor 70 is provided to allow ready access for maintenance.

The combination of the structure of the support frame for the jaw crusher 56 and vibratory floor feed 70 again serves to facilitate an arrangement which is relatively low in height so as to enable the module to fit within the confines of a standard underground drive.

The conveyor 72 is powered by the motor 76 and has a delivery end 74 projecting beyond the end of the skid 50.

A return conveyor 78 powered by motor 79 is also provided on skid 50.

The receiving end of the return conveyor 78 is provided with a chute 80 for receiving material from the next module and transferring it to the mouth 58 of the jaw crusher. The feed from the return conveyor 78 is delivered to the mouth 58 on the opposite side of the chain wall 60 to that delivered by the conveyor 36.

Figure 7:
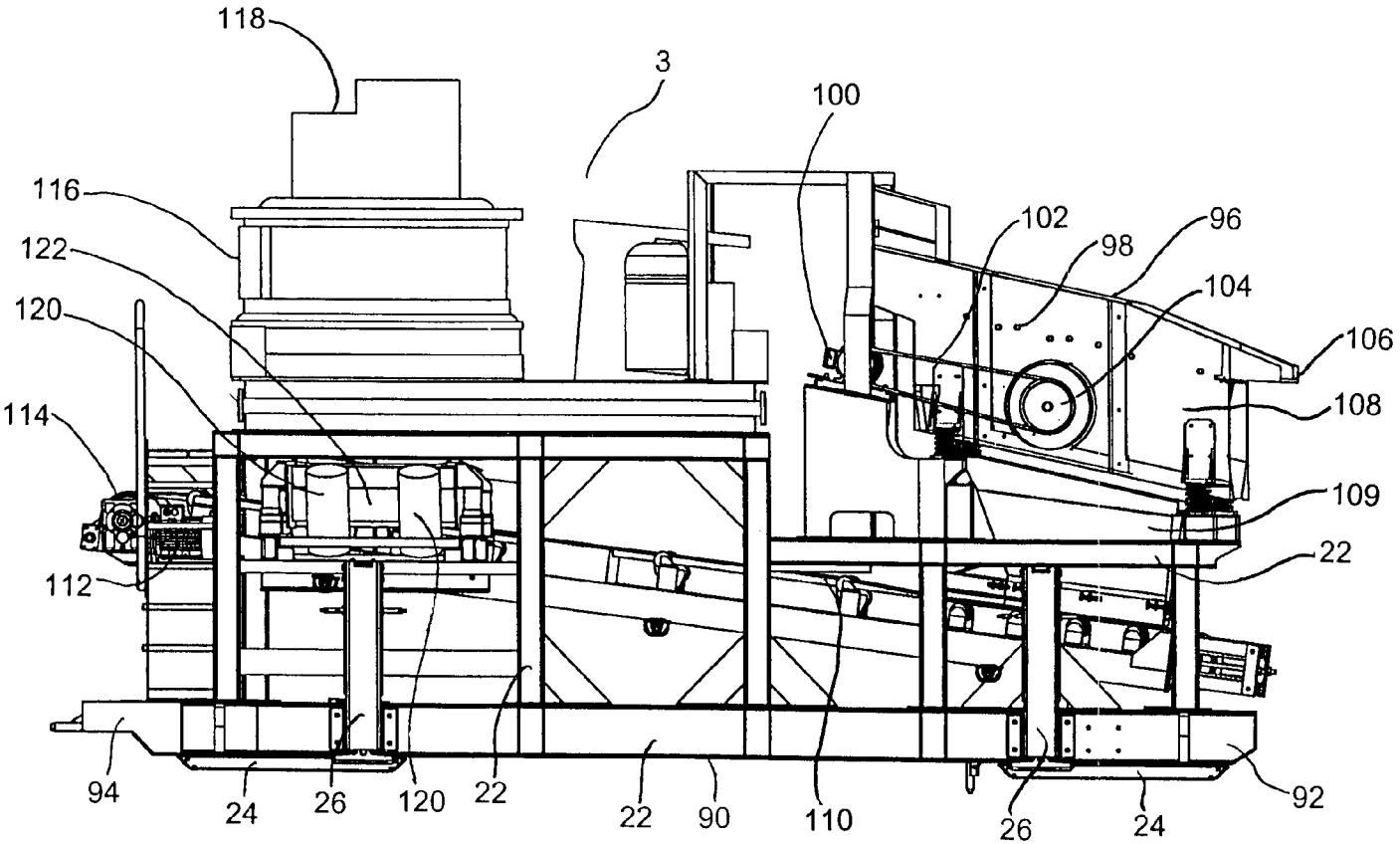
FIG. 7 is an elevational view of a crushing and screening module according to the invention.
Figure 8:
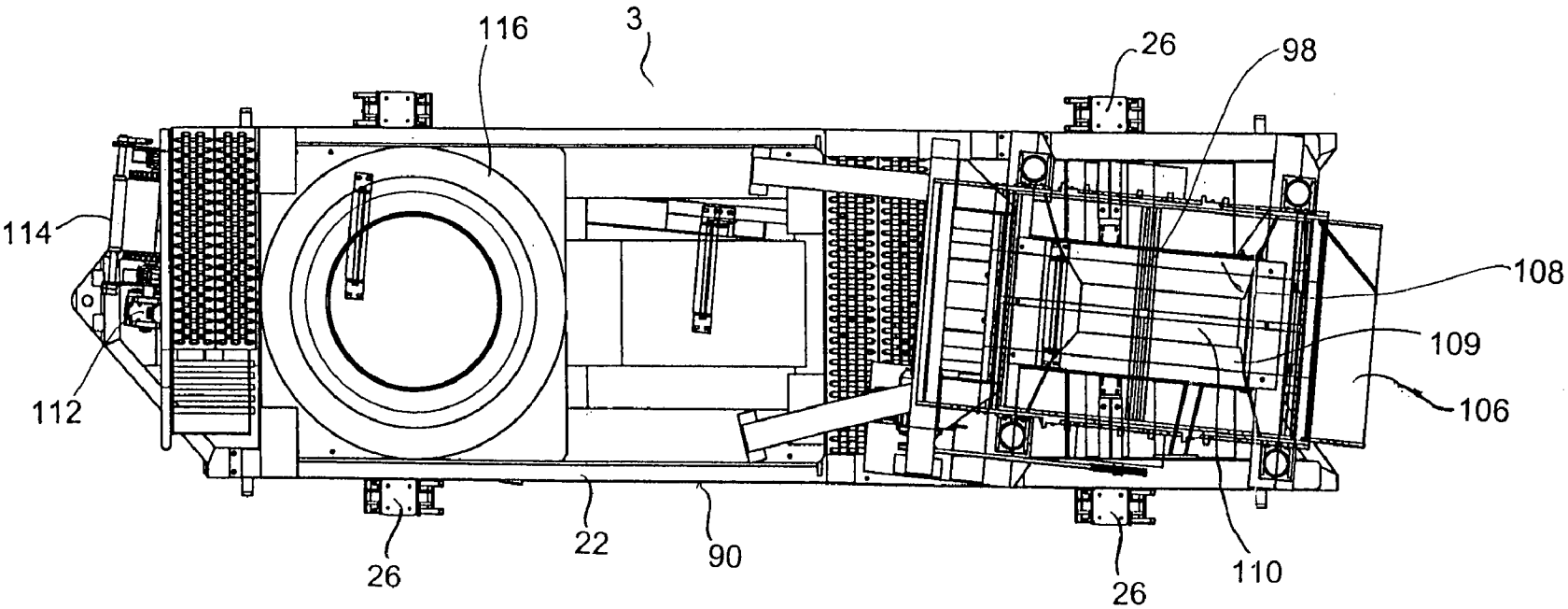
FIG. 8 is a plan view of the crushing and screening module of FIG. 7.
Figure 25:
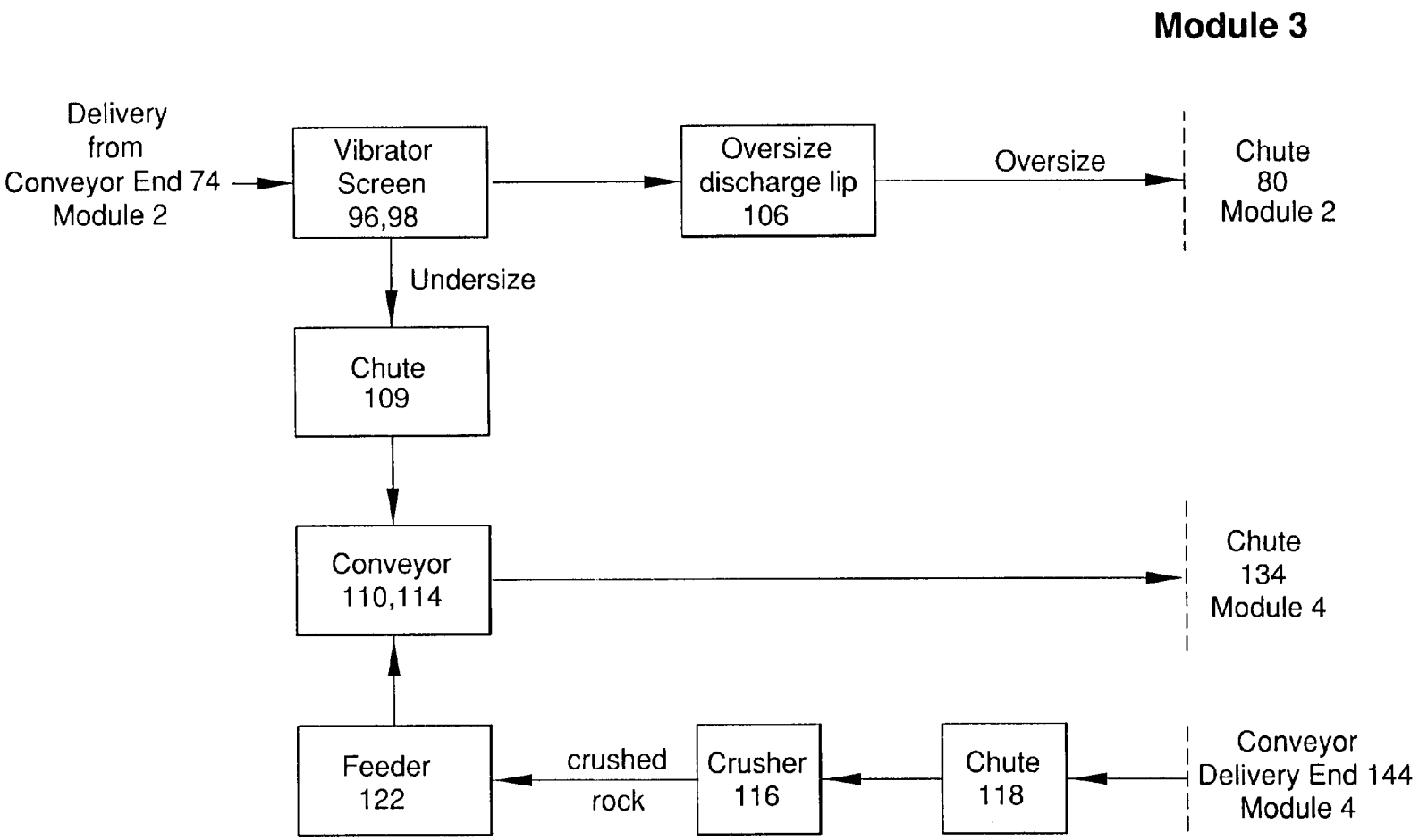
FIG. 25 is a schematic view of the crushing and screening module.

Referring to FIGS. 7, 8 and 25, there is shown a crushing and screening module generally designated 3.

The crushing and screening module 3 comprises a skid 90 provided with a socket end 92 for receiving a corresponding projecting end from the preceding skid 50. The opposite end of the skid 90 has a projecting end 94 for joining with the socket end of the next module.

The module 3 comprises a screen assembly 96 which includes a vibrating screen 98 shown in dotted form. The screen is driven by the motor 100 via the belt drive 102 and eccentric shaft 104.

The vibrating screen 98 has a lip 106 for returning oversize feed to the chute 80 of the preceding module 2. The vibrating screen may typically have an aperture of between 50 mm and 10 mm. An aperture about 25 mm may be suitable for typical gold recovery operations.

The vibrating screen is arranged above a chute 108. The chute directs undersize feed passing through the screen 98 into the chute 109 which in turn directs this undersize material to the conveyor 110.

The conveyor 110 is driven by the motor 112. It has a delivery end 114 arranged to drop the undersize feed into the chute 134 of the next module 4.

Module 3 is also provided with a secondary crusher 116 such as a vertical shaft impactor. The vertical shaft impactor has an inlet 118 arranged to receive returned feed from conveyor 144 of the next module, module 4.

A vibratory feeder 122 operated by the motors 120 is located beneath crusher 116. It directs crushed feed from the secondary crusher onto the conveyor 110 to mix with the undersize material from the screen assembly 96 which is already on the conveyor. It is noted that other forms of secondary crusher 116 other than a vertical shaft impactor could also be used in this situation. For example, a hammer mill or high pressure grinding rolls may be applicable as the case may be.

Figure 9:
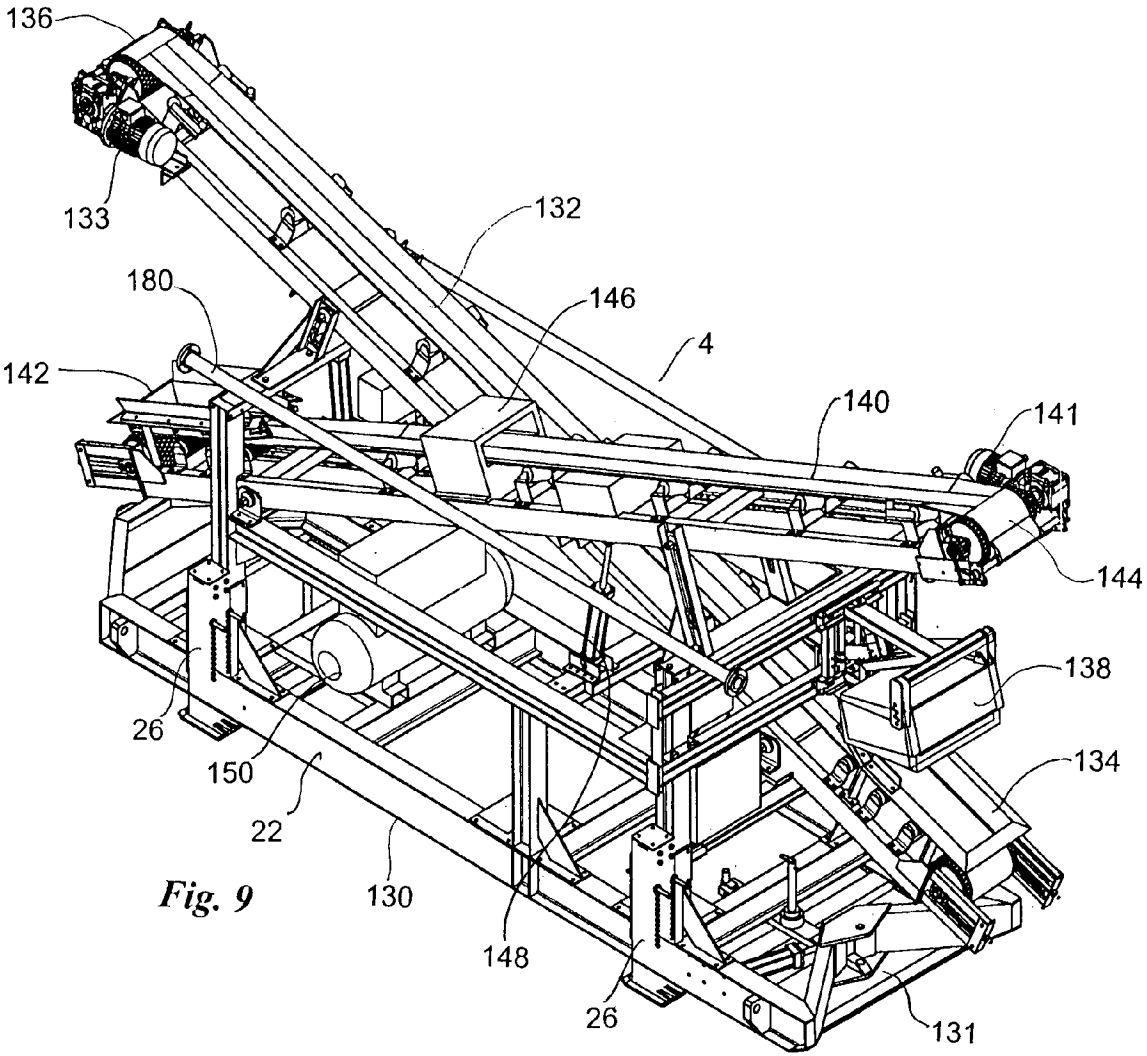
FIG. 9 is a perspective view of a conveyor module according to the invention.
Figure 10:
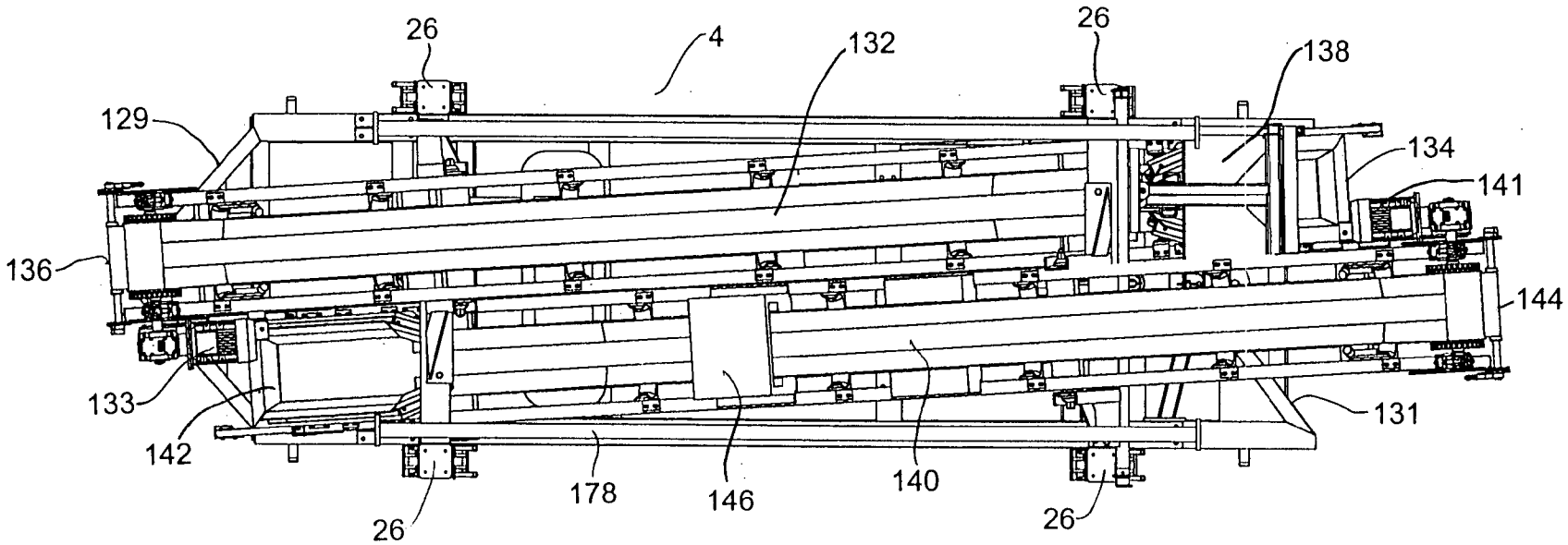
FIG. 10 is a perspective view of the conveyor module of FIG. 9.
Figure 11:
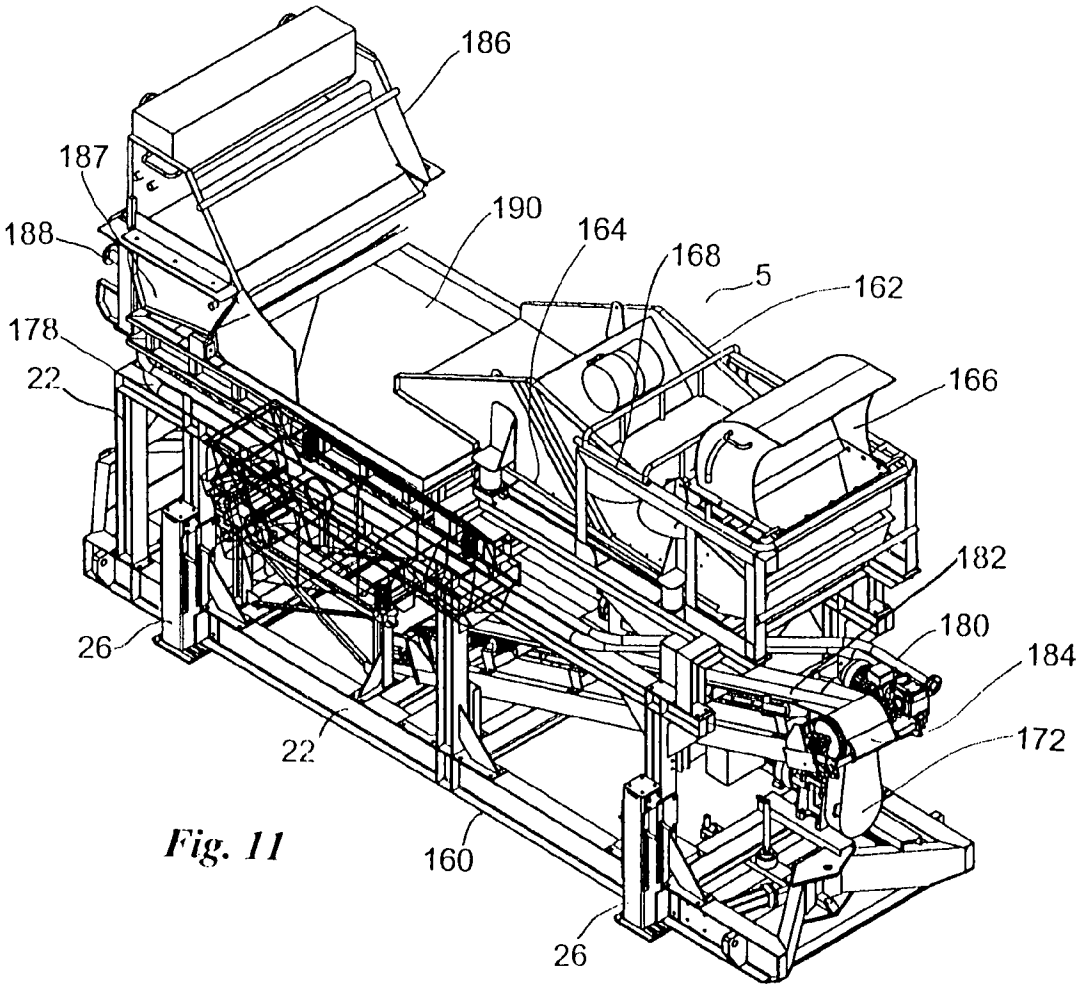
FIG. 11 is a perspective view of a secondary screening module according to the invention.
Figure 12:
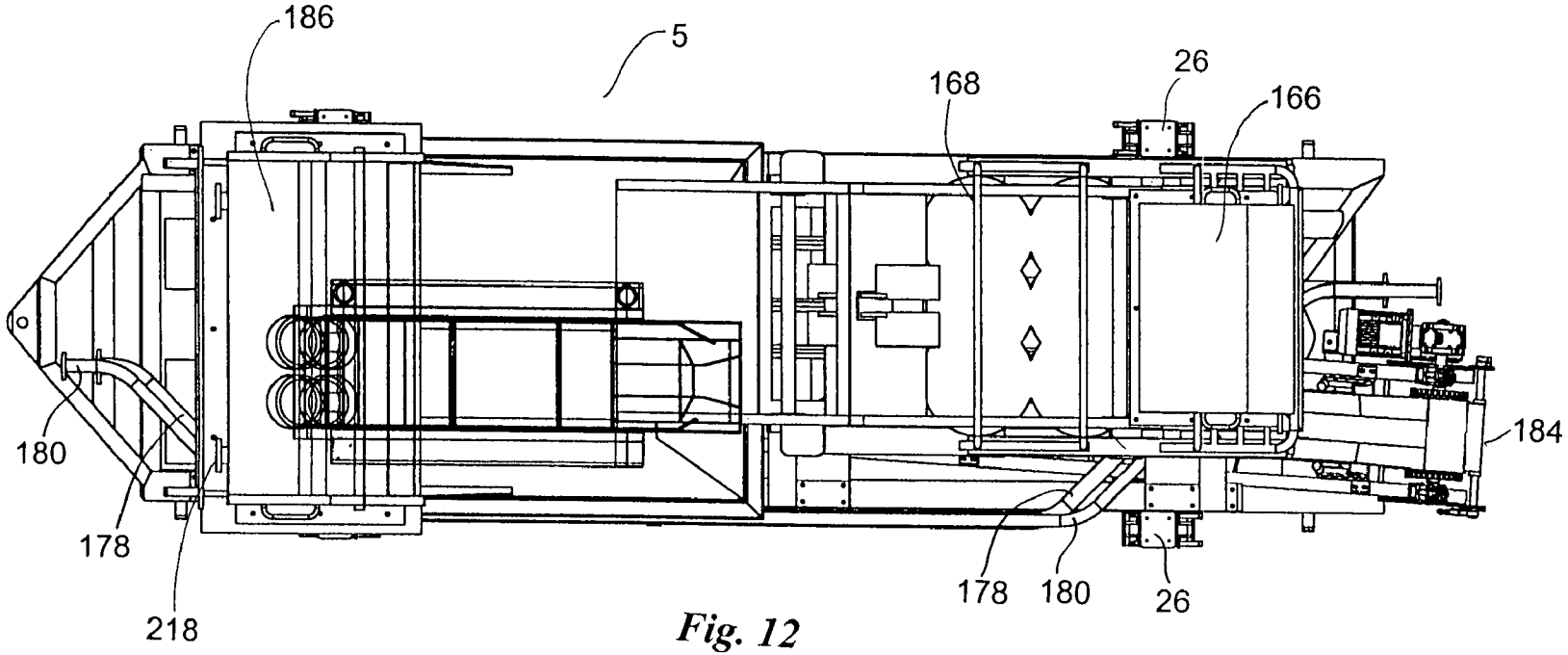
FIG. 12 is a plan view of the secondary screening module of FIG. 11.
Figure 13:
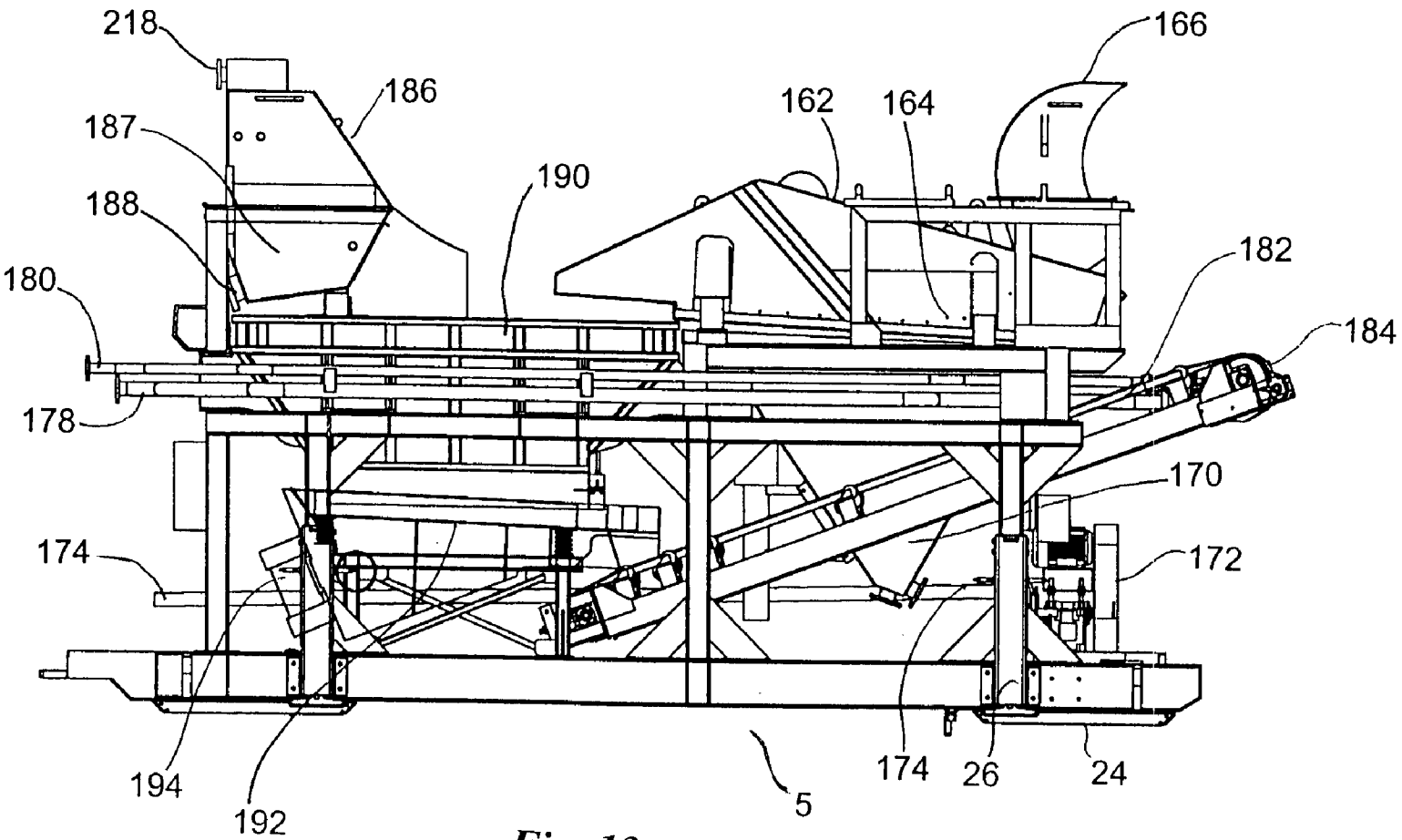
FIG. 13 is an elevational view of the secondary screening module of FIG. 11.
Figure 26:
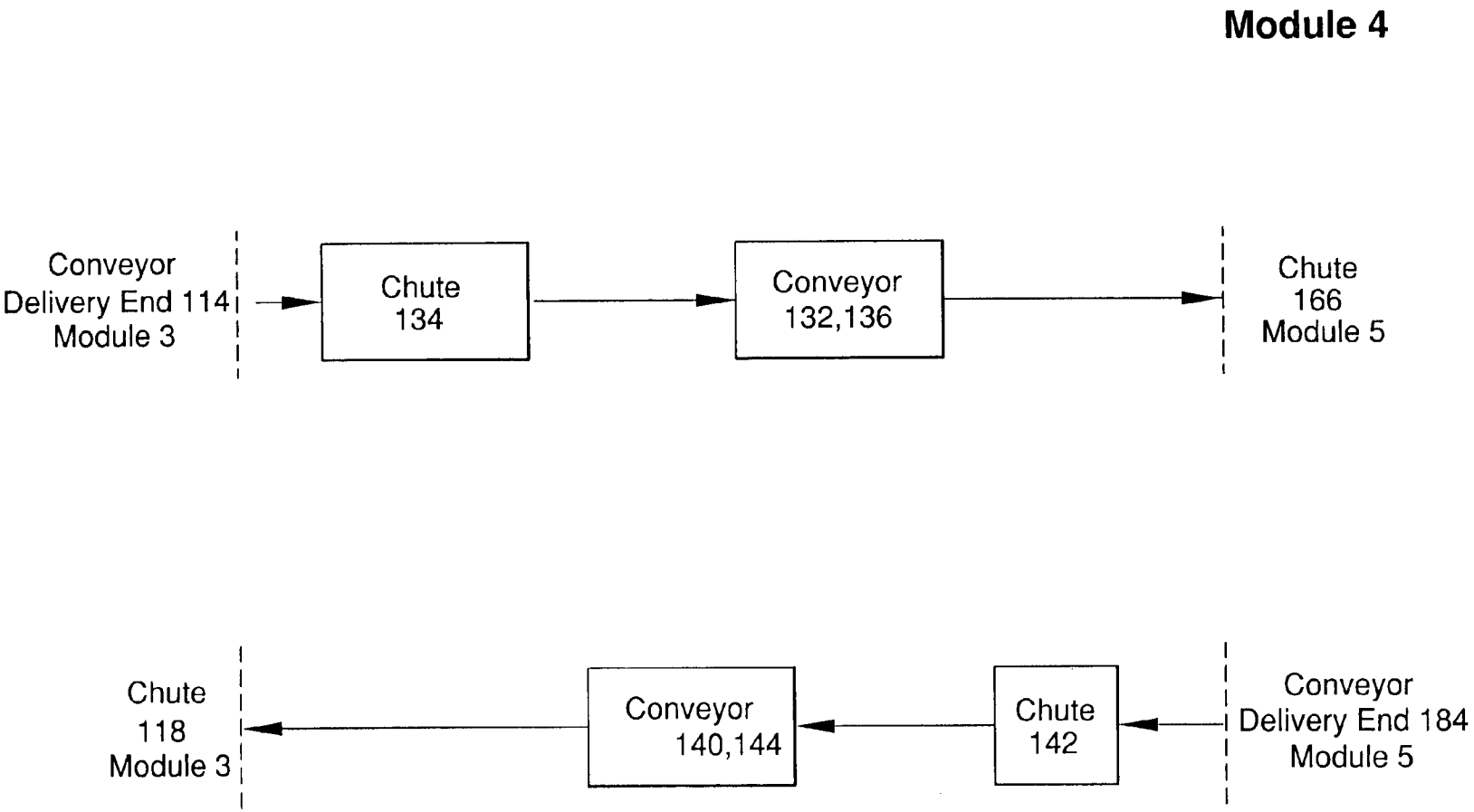
FIG. 26 is a schematic view of the conveyor module.
Figure 27:
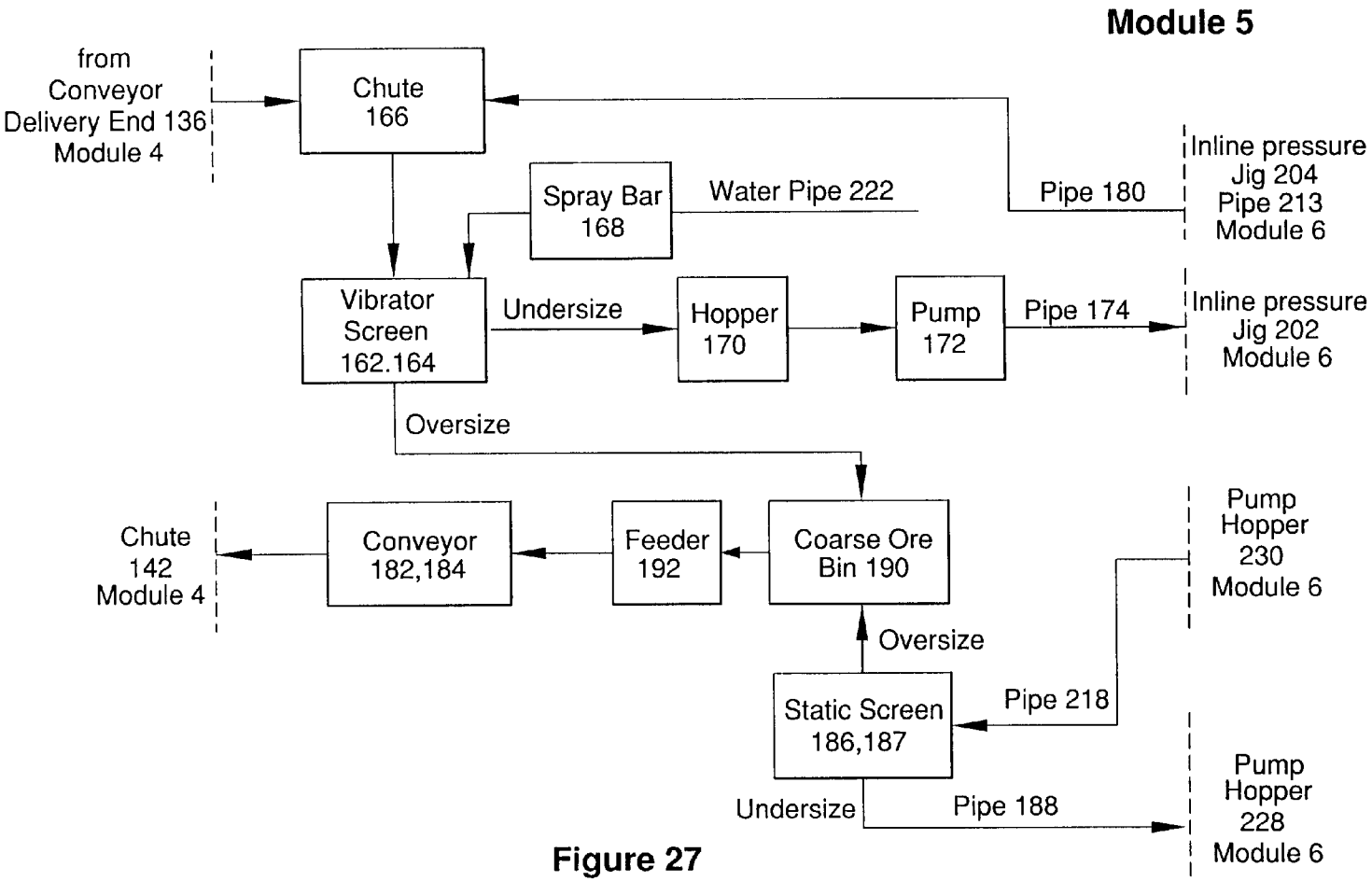
FIG. 27 is a schematic view of the secondary screening module.

Referring to FIGS. 9, 10 and 26, there is shown a conveyor module generally designated 4.

The conveyor module comprises a skid 130 with a projecting end 129 and socket end 131.

A receiver conveyor 132 is mounted on skid 130. It is driven by a motor 133.

A chute 134 mounted above receiver conveyor 132 is arranged to receive crushed feed from the delivery end 114 of conveyor 110 of the preceding module. This crushed feed material is raised by the receiver conveyor 132 to the level of the delivery end 136 and dropped into a chute 166 provided on the next module, module 5.

The magnet 138 is provided above the receiver conveyor 132 to remove any unwanted entrained magnetic materials in the crushed feed.

Module 4 also includes a return conveyor 140 which is driven by the motor 141.

The return conveyor 140 is arranged to receive feed material from module 5 via the chute 142. It is sloped to raise the feed to the level of the delivery end 144 and direct it into the inlet 118 of the secondary crusher 116 of the previous module.

A metal detector 146 is mounted above the return conveyor. The metal detector acts as a precautionary sensor to detect the presence of any metal in this part of the circuit.

A weightometer may be mounted above the return conveyor 140 in place of or in addition to the metal detector.

As the delivery end 144 of the return conveyor needs to be relatively high, given that it feeds material into the elevated inlet 118, the return conveyor 140 includes a hydraulic ram 148 for lowering the conveyor whilst it is being transported into position after which time it may be raised to its correct operating height.

As module 4 has an amount of free space it may also provide room for other items of general operating equipment such as the air compressor 150.

Referring to FIGS. 11 to 13 and 27, there is shown the secondary screening module 5 mounted on skid 160.

Module 5 includes the vibrating screen assembly 162 having a screen indicated by the dotted line 164. The screen 164 may typically have an aperture size between 1 mm and 10 mm. About 5 mm aperture size is usually preferred.

The screen assembly has a chute 166. The chute is arranged to receive feed supplied by receiver conveyor 132 from the preceding module. The screen assembly is arranged to drop undersize material into the undersize hopper 170 provided beneath.

A water spray bar 168 is mounted above and extends across the screen assembly 162. The water spray wets and helps to wash undersize material through the screen 164 into the undersize hopper 170 to form a slurry with the undersize material.

The slurry pump 172 is provided beneath the return conveyor 182. It is arranged to pump slurry from the undersize hopper 170 via the slurry pipe 174 to the next module, namely module 6.

A water service pipe 178 running along several modules provides water as needed for items such as the water spray bar 168 etc.

Module 5 also includes the pipe 180 which joins with pipe 213 for returning slurry tailings from the next succeeding module to the screen 164.

Module 5 also includes the static screen assembly 186. The static screen assembly includes a screen undersize hopper 187 for receiving undersize material. A coarse ore bin 190 is arranged to receive oversize material from the static screen assembly and the vibrating screen 164.

A vibrating feeder floor 192 powered by the motors 194 is arranged beneath the coarse ore bin 190 so as to transfer coarse ore onto the return conveyor 182.

The delivery end 184 of the return conveyor 182 is arranged to drop coarse ore into the chute 142 of the preceding module, module 4 to be returned by return conveyor 140 for further crushing by the crusher 116.

A pipe 188 is provided to take slurry from the return hopper 187 and deliver it to the pump 228 on a later module and hence to the cyclone 300 on a later module.

Figure 14:
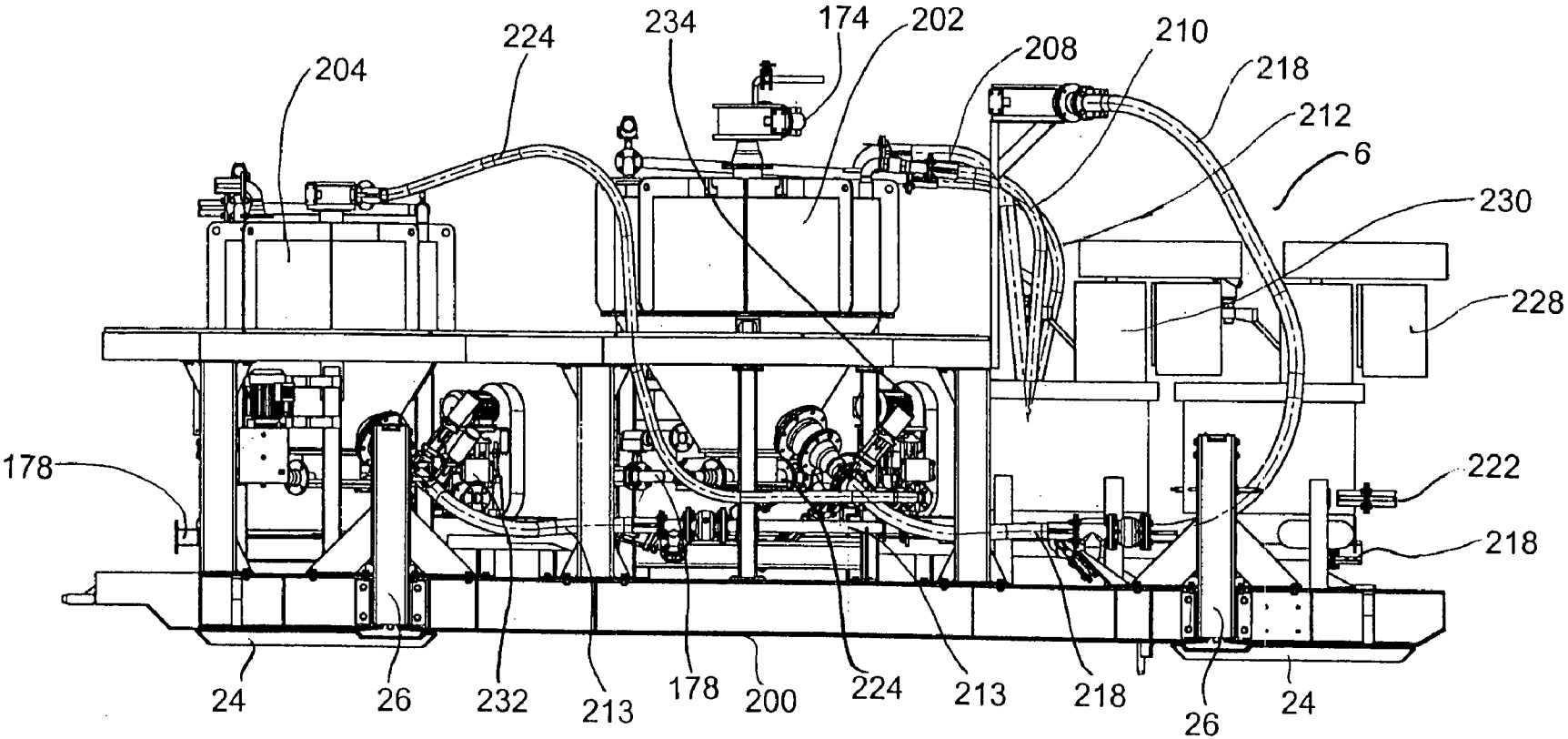
FIG. 14 is an elevational view of a concentration module according to the invention.
Figure 15:
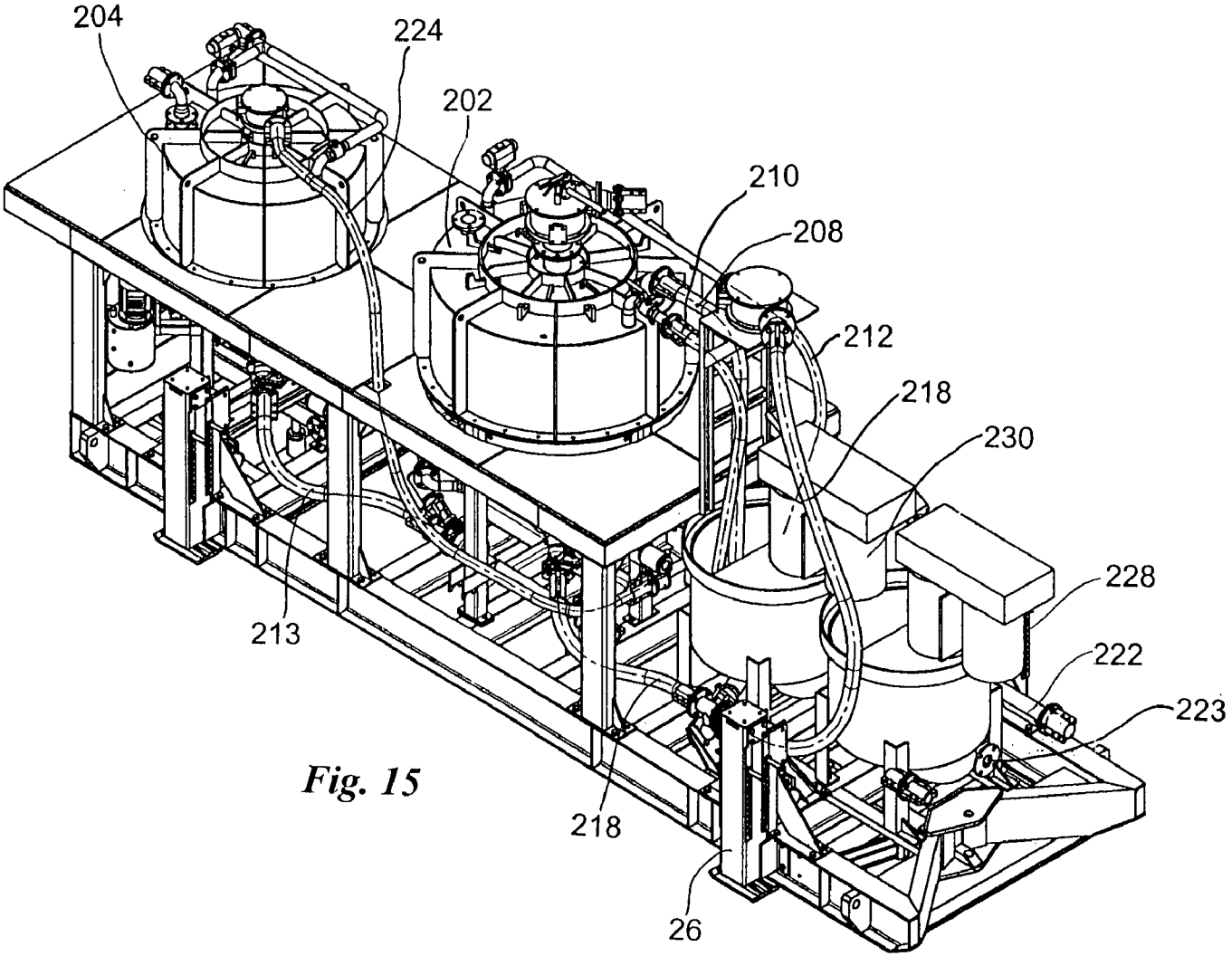
FIG. 15 is an isometric view of the concentration module of FIG. 14.
Figure 28:
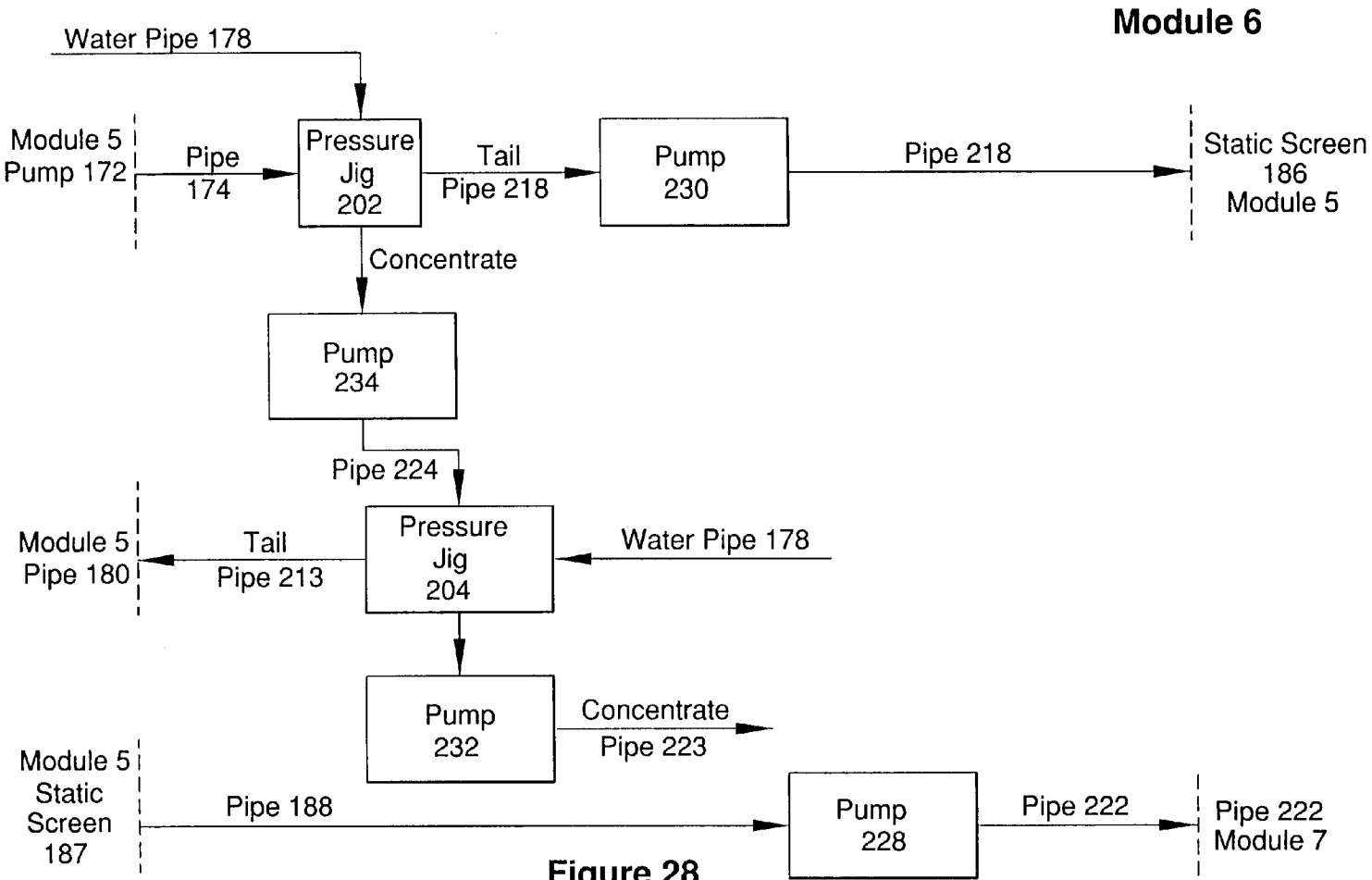
FIG. 28 is a schematic view of the concentration module.

Referring to FIGS. 14, 15 and 28, there is shown a concentration module 6 which is built on skid 200.

The concentration module includes a first pressure jig 202 and a second pressure jig 204 in series as shown in the drawing. They could also be installed in parallel in an alternative arrangement. Both the jigs are gravity separators of the type disclosed in Australian patent 684153 and corresponding U.S. Pat. No. 6,079,567.

Jig 202 is arranged to receive slurry via pipe 174 from the undersize hopper of the vibrating screen assembly 162.

The heavy minerals of the jig 202 are pumped by pump 234 through pipe 224 to the inlet of jig 204.

Water via water services pipe 178 is directed to the rougher jig. Tailings from the rougher jig are taken via pipe 218 to the pump 230 and then to static screen assembly 186.

Tailings from the second jig are returned via pipe 213 and pipe 180 to the vibrating screen assembly 162.

Pump 230 is provided to direct tailings from the first jig which acts as a rougher jig through pipe 218 to the static screen 186 and pump 232 is provided to pump concentrate from the second jig which acts as a cleaner jig through a pipe (not shown) to be collected as product or for further processing.

Pump 232 directs final concentrate via pipe 223 to a collection station for further processing.

The jig 202 is provided with several air bleed pipes 208, 210 and 212.

Figure 16:
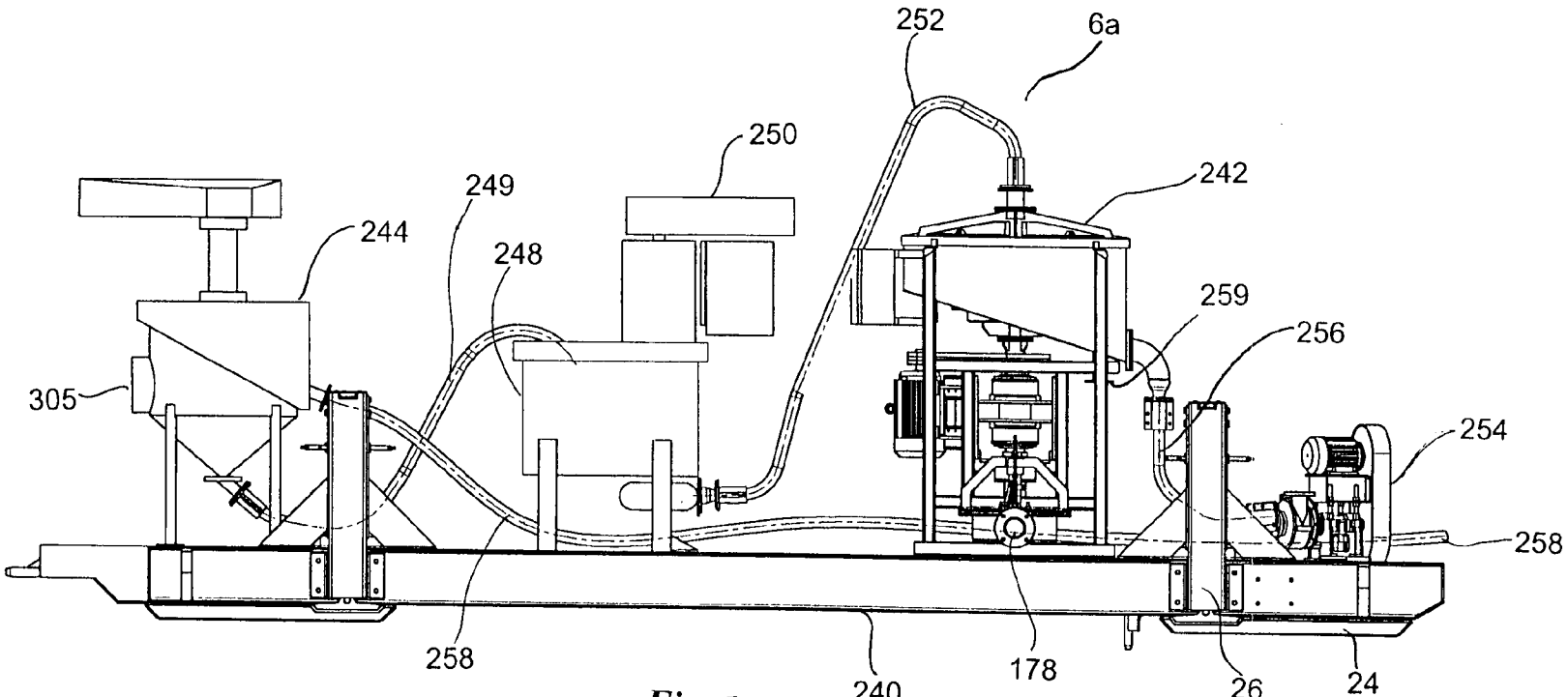
FIG. 16 is an elevational view of a fines separation module according to the invention.
Figure 17:
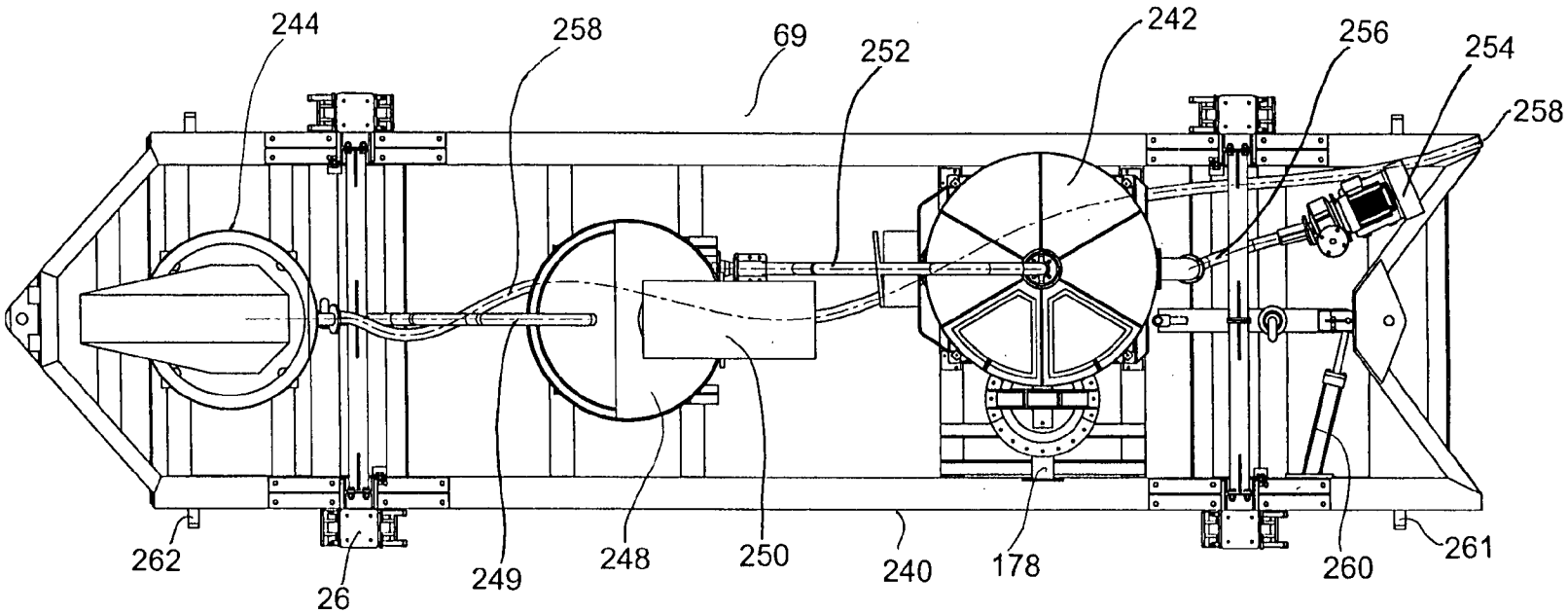
FIG. 17 is a plan view of the fines separation module of FIG. 15.
Figure 29:
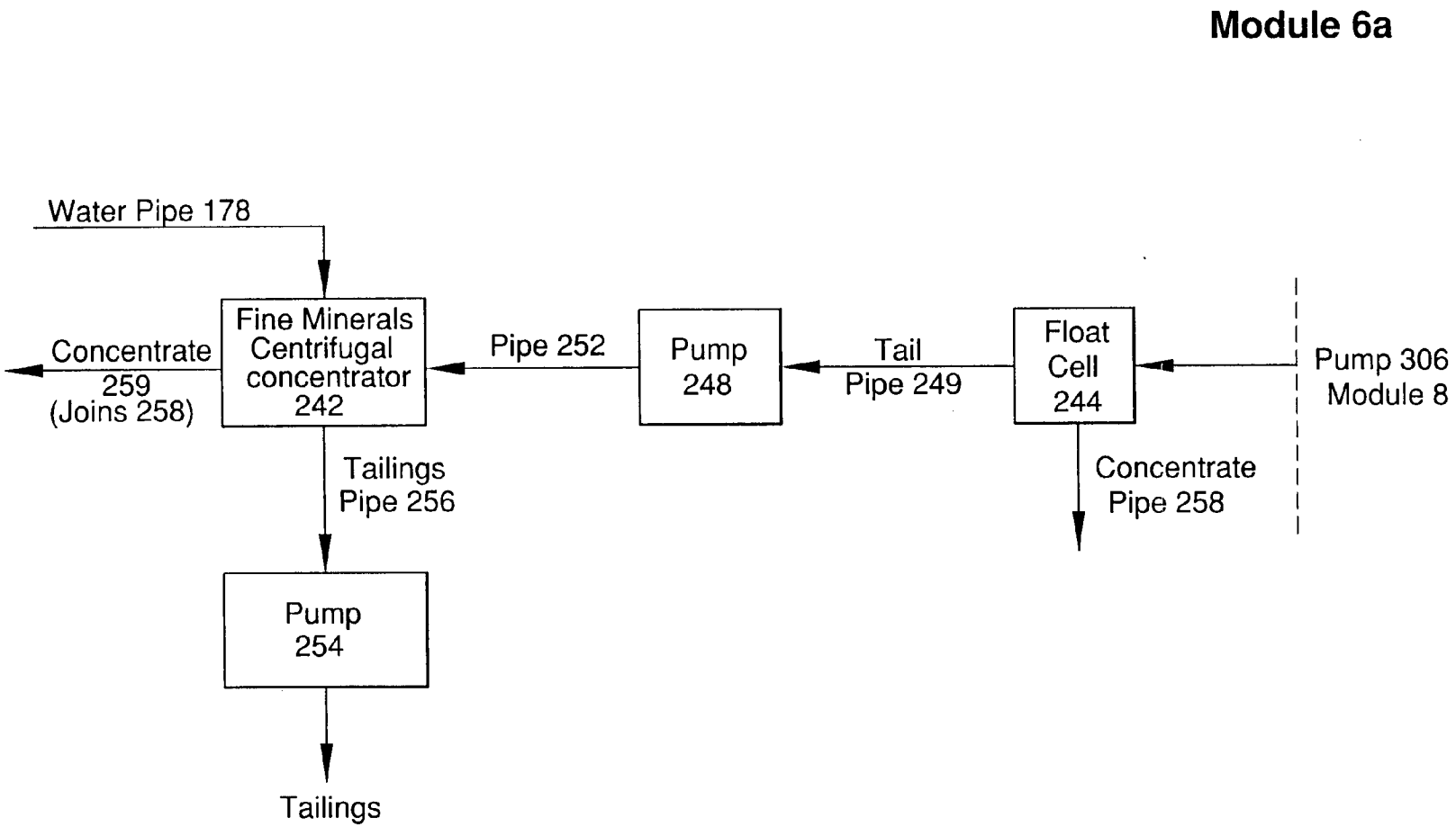
FIG. 29 is a schematic view of the fines separation module.

Referring to FIGS. 16, 17 and 29, there is shown an optional fines separation module generally designated 6*a*. The fines separation module may be included between concentration module 6 and recycle module 7 to be discussed hereinafter.

The fines separation module 6*a* is constructed on skid 240. Mounted on the skid are a centrifugal concentrator 242, such as a Kelsey jig, a flotation cell 244 and pumps 248 and 254.

The flotation cell is set up to receive tailings from the cyclone 300 via pipe 305 and pump 306. A final concentrate from the flotation cell is taken off by pipe 258.

The underflow from the flotation cell is directed via pipe 249 to the pump 248 from where it can be pumped via pipe 252 to the centrifugal concentrator 242 for further concentration.

The final concentrate pipe 258 is arranged to take product concentrate from the centrifugal concentrator and flotation cell. There is a pipe 256 which directs tailings waste via pump 254 to a dump or similar.

It should be noted from FIG. 17 that all skids are optionally provided with an hydraulic cylinder which may be configured to change the direction of an optional axle 261 for removable wheels when the skid is being transported. A second axle 262 is also optionally provided at the projecting end of the skid for provision of removable wheels as well.

Figure 18:
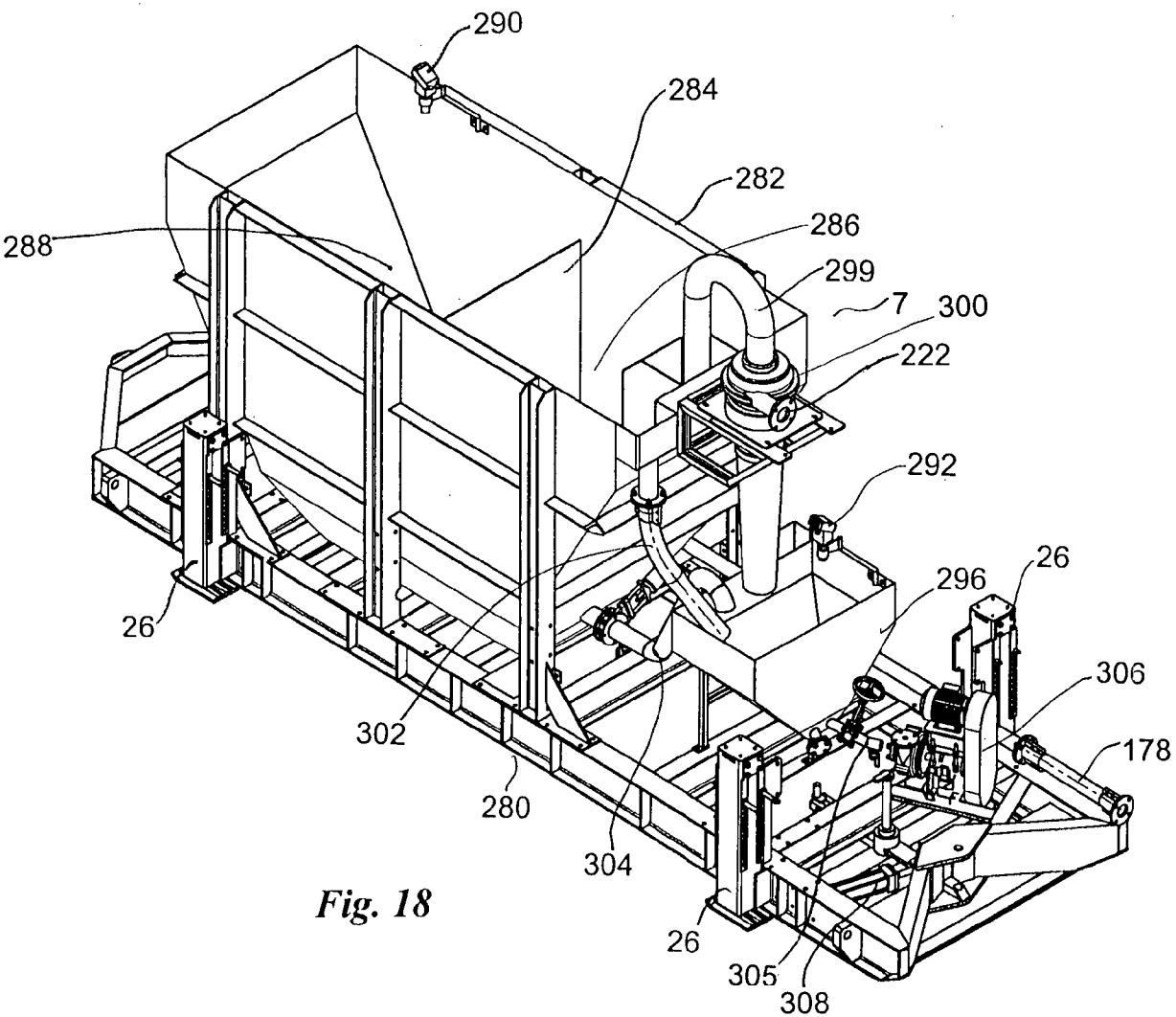
FIG. 18 is a perspective view of a recycle module according to the invention.
Figure 19:
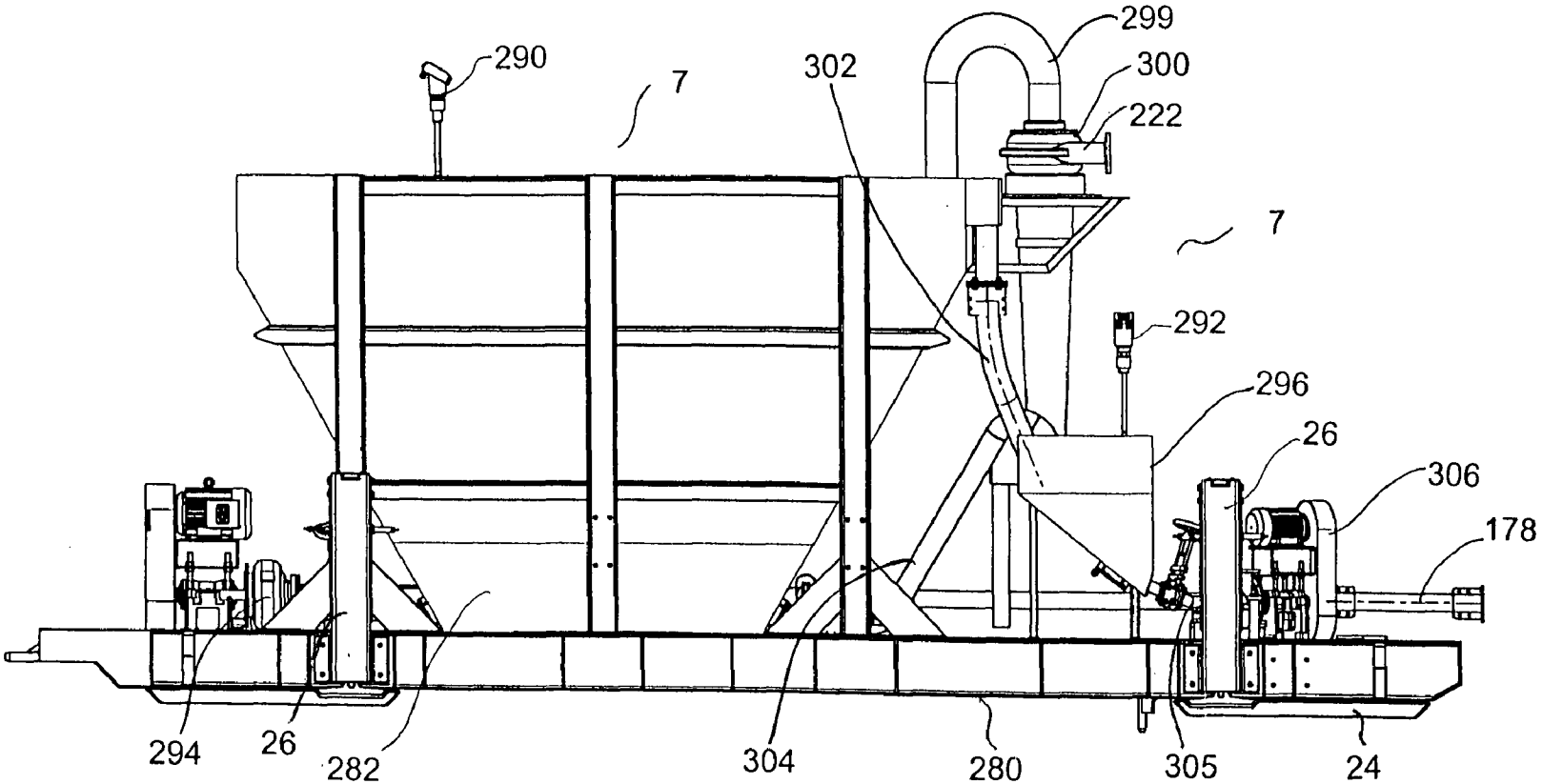
FIG. 19 is an elevational view of the recycle module of FIG. 17.
Figure 30:
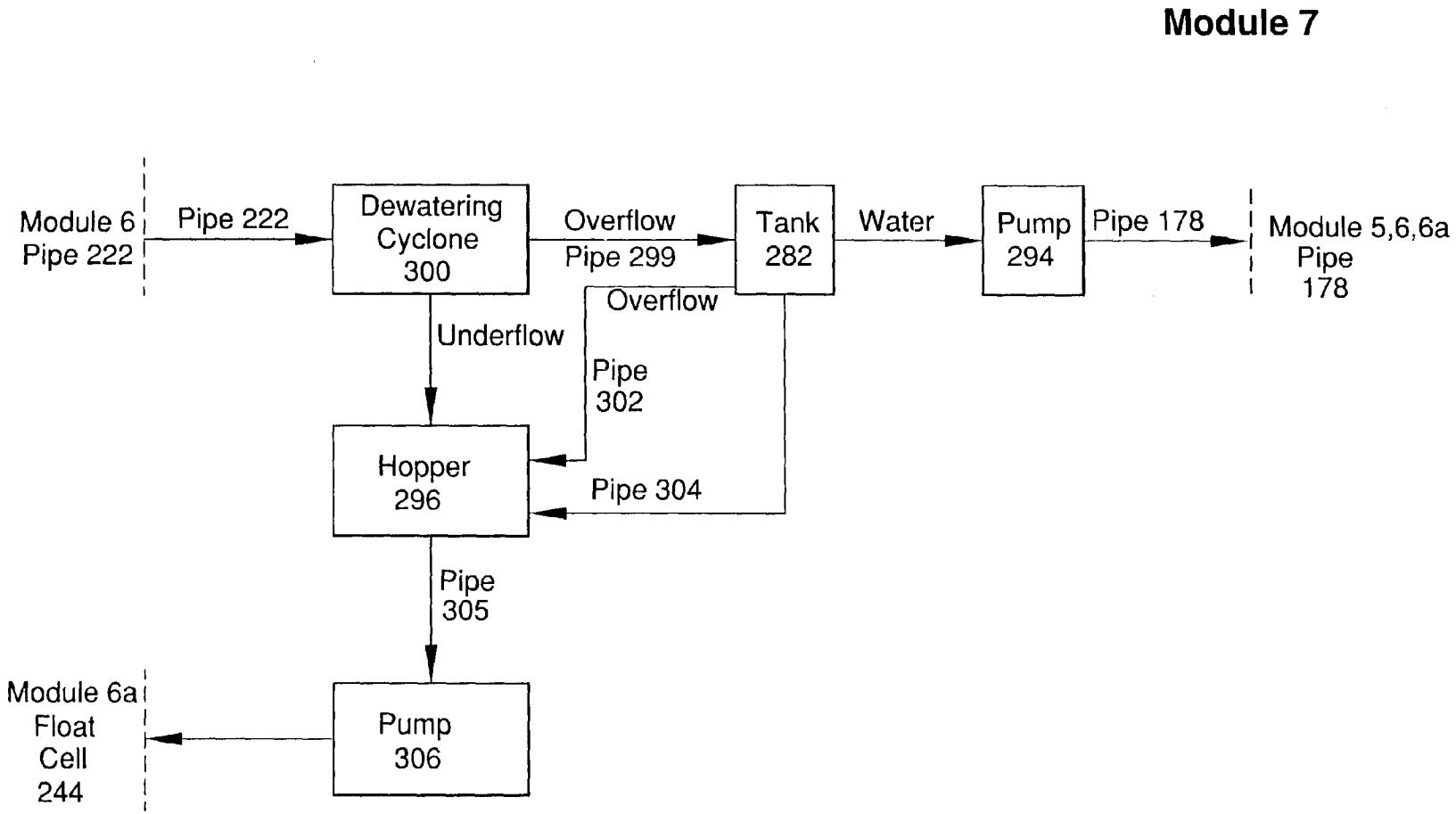
FIG. 30 is a schematic view of the recycle module.

Referring to FIGS. 18, 19 and 30, the recycle module generally designated 7 is constructed on skid 280.

The module comprises a tank 282 divided into a sludge compartment 286 and overflow water compartment 288 by the baffle 284.

A tails hopper 296 is located adjacent the tank 282.

Level sensors 290 and 292 are provided for the tank and tails hopper respectively.

The module includes a pump 294 for recycling process water through pipe 178 to the other modules.

The cyclone 300 is arranged to receive underflow from the static screen via pipe 188 and to direct cyclone overflow water via the pipe 299 to the tank.

The underflow of the cyclone is directed into the tails hopper 296. In addition, the tails hopper receives overflow water from the tank via the overflow pipe 302.

A desludge pipe 304 takes settled sludge from the bottom of the sludge compartment and directs it into the tails hopper as well.

A tails pump 306 is arranged to pump the tails to waste or to the fines separation module 6*a* as previously discussed via pipe 305.

The skid may optionally have an hydraulic cylinder 308 for steering as has been described with reference to the fines separation module. All the other skids may have similar steering arrangements.

Figure 20:
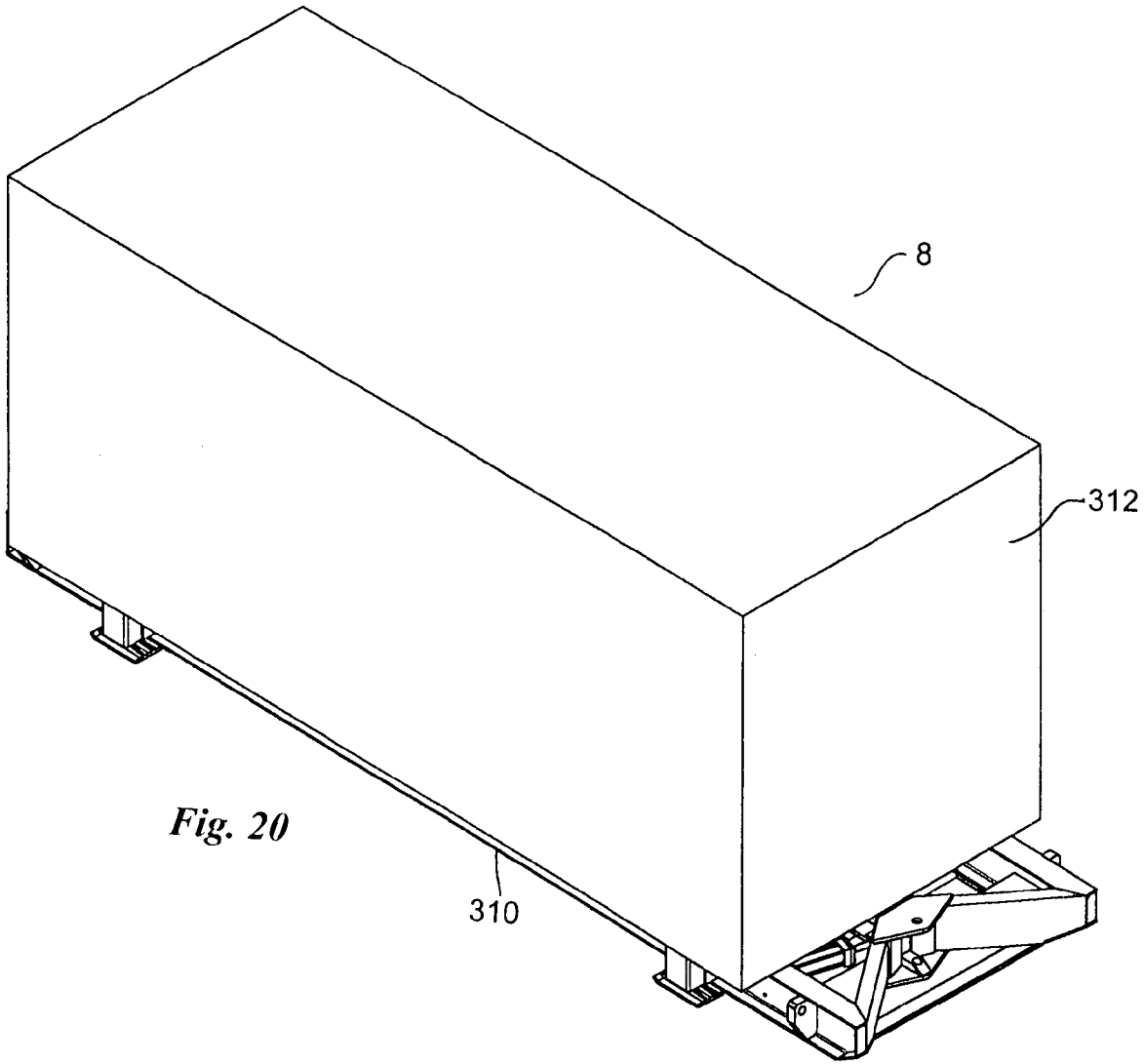
FIG. 20 is a perspective view of a control module according to the invention.

Referring to FIG. 20, there is shown an optional control module generally designated 8 constructed on skid 310. This module simply comprises a housing 312 within which the controls for the various modules may be housed.

Figure 21:
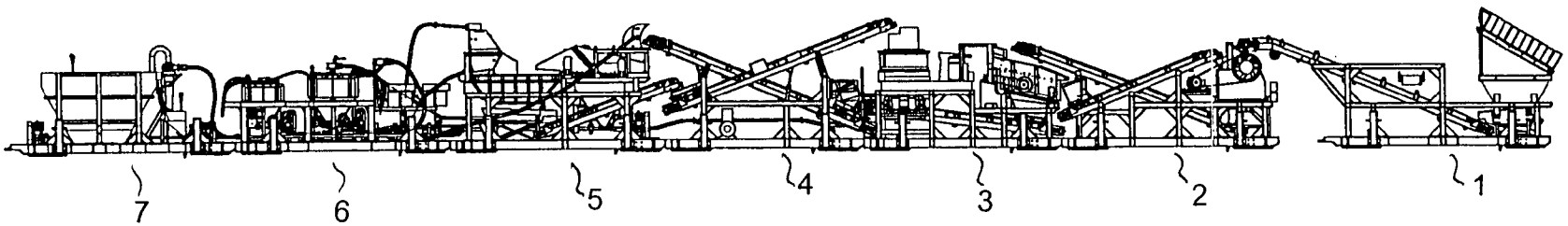
FIG. 21 is an elevational view of a modular feed processing system according to the invention.

Referring to FIG. 21, there is shown an elevational view of a typical arrangement of a modular feed processor according to the invention with the modules 1, 2, 3, 4, 5, 6 and 7 previously described and joined end to end in operating arrangement. The control module 8 (not shown) may be located at the downstream end of the modular feed processor or at another nearby location.

Figure 22:
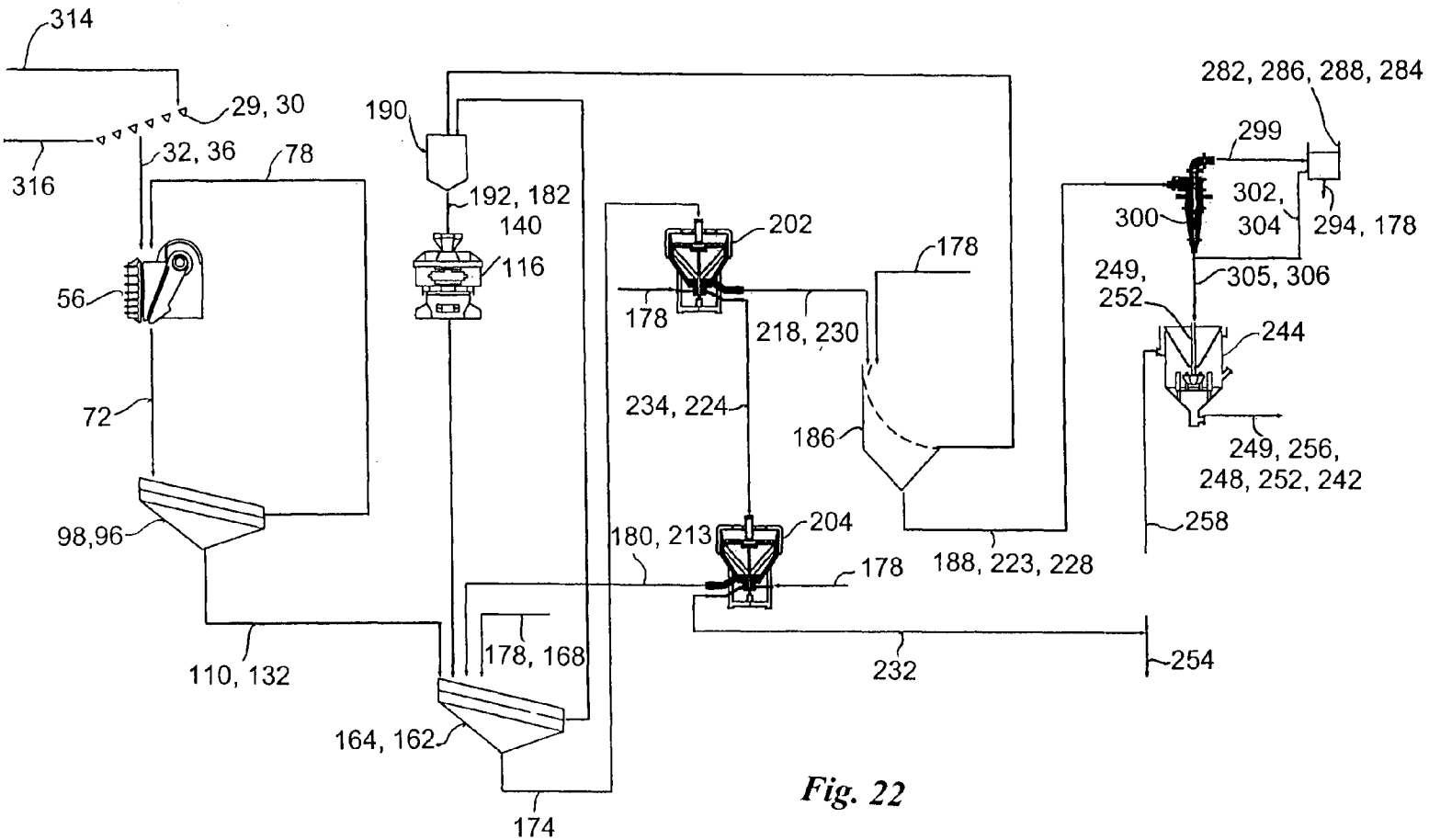
FIG. 22 is a schematic view of a modular feed processing system according to the invention.
Figure 23:
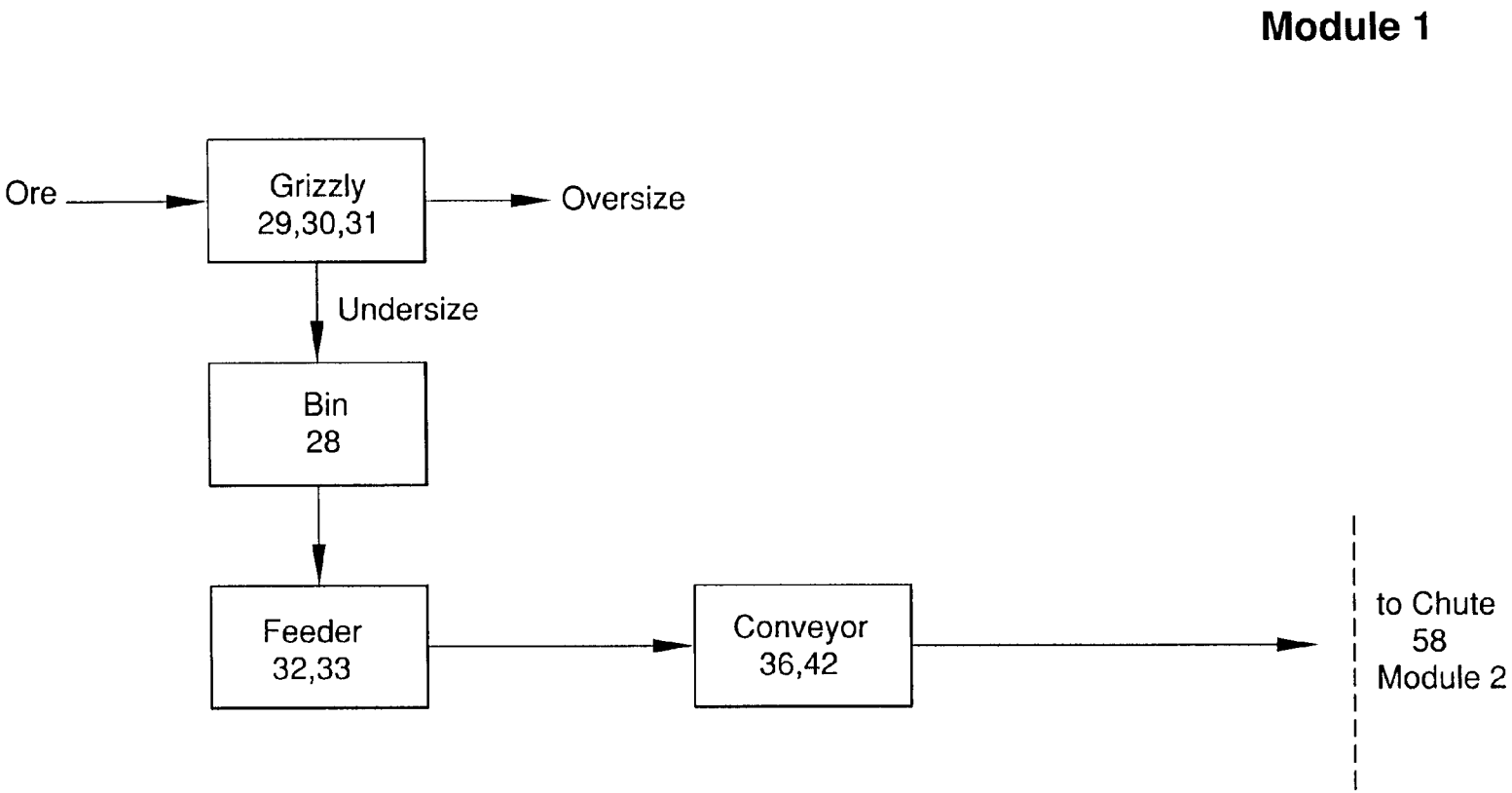
FIG. 23 is a schematic view of the feeder module.

Referring to FIG. 22, the operational arrangement of FIG. 21 including an extra module 6*a* as previously described interposed between modules 6 and 7 is shown in a schematic form. The integers used are those described with reference to the preceding drawings.

In operating the modular processing system, ore 314 is fed to the grill assembly 29 of the first module. Oversize ore 316 falls off the grill assembly onto the ground so that it can be broken up further. The grill assembly otherwise known as a grizzly directs the undersize ore through a feed hopper. Ore is withdrawn from the feed hopper by vibrating feeder 32 onto the rubber conveyor 36. A belt magnet 40 removes tramp metal (eg. bucket teeth, rockbolts and plates) off the conveyor prior to ore delivery to a single jaw crusher 56.

The jaw crusher, operating at a closed side setting (40 mm), discharges ore through a vibrating feeder 70 onto a belt conveyor 72 where it is carried to a vibrating screen. This may typically have an aperture of about 25 mm. The +25 mm ore reports to rubber belt conveyor 78 that returns the oversize material to the jaw crusher. The −25 mm ore is conveyed via a conveyor with a weightometer and transferred to a second belt which discharges to a wet secondary screen 162 having an aperture of about 5 mm. The +5 mm material is discharged to the surge ore coarse ore hopper 190.

The material in the coarse ore hopper is discharged via a vibrating feeder 192 onto the conveyor to a belt 182 feeding the vertical shaft impactor 116 for further crushing. A magnet may also be installed above the belt to remove smaller tramp metal.

Typically, the vertical shaft impactor will discharge ore with a P30 of 1 mm (ie. only 30% of the ore is crushed below 1 mm in a single pass creating a circulating load of typically about 300%).

The −5 mm slurry which is discharged from the 5 mm screen is pumped to the rougher inline pressure jig 202. The concentrate (gold and any other heavy minerals) is cleaned in the cleaner jig 204. The tailings from the rougher jig are pumped to a tertiary screen in the form of the static screen assembly 186 (typically 1 mm aperture static screen). The +1 mm ore drops into the coarse ore bin for reprocessing in the vertical shaft impactor. The −1 mm ore is either pumped to water recovery (a hydrocyclone 300 designed to recover most of the solids in the underflow and recycle water back to the inline pressure jigs and screens) or to further processing in a module incorporating a centrifugal separator 242 and/or flotation cell 244.

The tailings from the cleaner jig are pumped to the 5 mm screen for reprocessing through the jig circuit. The cleaner jig concentrate 232 is either pumped to the surface or dewatered and placed in skips or trucks for cartage to the surface of the mine.

Whilst the above description includes the preferred embodiments of the invention, it is to be understood that many variations, alterations, modifications and/or additions may be introduced into the constructions and arrangements of parts previously described without departing from the essential features or the spirit or ambit of the invention.

It will be also understood that where the word "comprise", and variations such as "comprises" and "comprising", are used in this specification, unless the context requires otherwise such use is intended to imply the inclusion of a stated feature or features but is not to be taken as excluding the presence of other feature or features.

The reference to any prior art in this specification is not, and should not be taken as, an acknowledgment or any form of suggestion that such prior art forms part of the common general knowledge in Australia.

The invention claimed is:

1. A modular ore processing system comprising, a feeder module for rejecting oversize ore for break up and accepting undersize ore for crushing, a primary crushing module for crushing the undersize ore to form a feed, a screening module for sizing the feed, and a concentration module for concentrating the feed, wherein, the modules are constructed so that they are operatively joinable end to end to form the modular ore processing system, the dimensions of the modules being such that the modular ore processing system may be assembled in the drive of a mine, and the primary crushing module comprises, a crusher chute arranged to direct ore to fall into a primary crusher, a crusher return conveyor arranged to transfer oversize feed from another module to the primary crusher, a primary crusher delivery conveyor arranged to transfer feed from the primary crusher to another module, and a primary crushing module vibratory floor arranged to receive feed from the primary crusher and to drop the feed onto the primary crusher delivery conveyor.

2. The modular ore processing system according to claim 1 comprising at least five modules.

3. The modular ore processing system according to claim 1 wherein each module has a width between 1.5 and 5 meters, a height less than 5 meters and a length less than 11 meters.

4. The modular ore processing system according to claim 3 wherein each module has a width of 1.8 to 3.5 meters and a length of 5 to 10 meters.

5. The modular ore processing system according to claim 4 wherein the feeder module comprises a grill arranged to reject oversized ore for further breakup and a feeder module conveyor for transferring ore which has passed through the grill to a succeeding module.

6. The modular ore processing system according to claim 5 wherein bars forming the grill of the feeder module extend at an angle to the horizontal such that oversize ore falls off the grill onto ground behind or next to the feeder module.

7. The modular ore processing system according to claim 5 wherein the grill is rotatable to allow the feeder module to receive ore from a plurality of directions.

8. A modular ore processing system according to claim 5 comprising a bin arranged to direct ore which has passed through the grill onto a feeder module vibratory floor which is arranged to drop the ore onto the feeder module conveyor.

9. The modular ore processing system according to claim 5 comprising a magnet arranged above the feeder module conveyor for removing metal entrained in ore on the feeder module conveyor.

10. The modular ore processing system according to claim 3 wherein each module is constructed on a skid.

11. The modular ore processing system according to claim 10 wherein the skid has a width of about 2.5 meters and length of about 8.5 meters.

12. The modular ore processing system according to claim 10 wherein each module is provided with opposed ends, one of which forms a projection and the other a recess for receiving a projection from an adjacent module whereby adjacent modules may be nested together end to end.

13. The modular ore processing system according to claim 3 comprising skid plates provided underneath opposed ends of each module and wheels for facilitating transport.

14. The modular ore processing system according to claim 1 wherein the primary crusher comprises at least one of a jaw crusher and a hammer mill.

15. The modular ore processing system according to claim 1 having a secondary crushing module for crushing and screening comprising, a primary screen arranged to receive feed from another module, a chute for directing undersize feed from the primary screen onto a secondary crushing module conveyor, and a secondary crusher for crushing feed from another module and directing it to the secondary crushing module conveyor.

16. The modular ore processing system according to claim 15 wherein the primary screen is a vibrating screen having apertures between 10 mm and 50 mm and a chute for dropping undersize feed onto the secondary crushing module conveyor is provided beneath the primary screen.

17. The modular ore processing system according to claim 15 comprising a lip on the primary screen for discharging oversize feed to another module.

18. The modular ore processing system according to claim 15 comprising a secondary crushing module vibratory floor arranged to receive feed from the secondary crusher and to drop it onto the secondary crushing module conveyor.

19. The modular ore processing system according to claim 1 including a conveyor module comprising receiver and return conveyors each arranged to transfer feed in generally opposite directions so as to receive feed from another module at one end of the conveyor module and to transfer it to a further module at its opposite end.

20. The modular ore processing system according to claim 19 wherein the height of at least one of the receiver and return conveyors is adjustable.

21. The modular ore processing system according to claim 19 wherein a magnet is mounted above at least one of the receiver and return conveyors to remove magnetic materials entrained in the feed.

22. The modular ore processing system according to claim 19 comprising a weightometer for measuring weight of feed transferred by the return conveyor.

23. The modular ore processing system according to claim 19 comprising a metal detector for sensing presence of metal in feed on the return conveyor.

24. The modular ore processing system according to claim 1 having a secondary screening module comprising, a chute for directing feed to a secondary screen, a water spray supply arranged to direct a water stream on to the feed, a secondary screening module pump for pumping a slurry of undersize feed from the secondary screen and water to another module, a tertiary screen provided with a first slurry conduit for delivering a slurry feed from another module to the tertiary screen, a second slurry conduit arranged to take off undersize slurry feed from the tertiary screen, and a secondary screening module conveyor arranged to receive oversize feed from the secondary and tertiary screens to deliver the oversize feed to another module.

25. The modular ore processing system of claim 24 comprising a coarse ore bin for receiving the oversize feed from the secondary and tertiary screens prior to transfer to the secondary screening module conveyor.

26. The modular ore processing system of claim 25 comprising a secondary screening module vibratory floor arranged to drop feed from the coarse ore bin onto the secondary screening module conveyor.

27. The modular ore processing system of claim 24 wherein, the water spray supply comprises a water spray bar arranged above the secondary screen, a secondary screening module hopper is arranged to receive the undersize feed slurry from the secondary screen, and the secondary screening module pump is arranged to pump the undersize feed slurry from the secondary screening module hopper.

28. The modular ore processing system according to claim 1 wherein the module for concentrating the feed is a primary concentration module comprising, a first pressure jig for concentrating a slurry feed from another module, a second pressure jig arranged to receive a primary concentrated feed from the first pressure jig, an intermediate pump for pumping the primary concentrated feed from the first pressure jig to the second pressure jig, a transfer pump for pumping secondary concentrated feed from the second pressure jig to another location.

29. The modular ore processing system according to claim 28 comprising a tailings pump for pumping tailings from the first pressure jig to another module for recycling.

30. The modular ore processing system according to claim 1 including a fines separation module comprising, a flotation cell for separating a flotation concentrate from a feed slurry, a flotation tailings pump for pumping flotation tailings from the flotation cell to a concentrator, a concentrator pump for pumping concentrator tailings to waste, a concentrator conduit for delivering concentrate from the concentrator to a product delivery point.

31. The modular ore processing system according to claim 30 wherein the concentrator comprises a fine minerals centrifugal concentrator which is fed by a water supply conduit.

32. The modular ore processing system according to claim 1 including a recycle module comprising, a dewatering cyclone arranged to receive a slurry feed, an underflow hopper arranged to receive an underflow with an increased concentration of solids from the dewatering cyclone, an overflow tank arranged to receive overflow reduced in concentration of solids from the dewatering cyclone, an underflow pump for pumping underflow from the underflow hopper to another module, an overflow pump for returning water from the overflow tank to another module, and a conduit for delivering sludge from the overflow tank to the underflow hopper.

33. The modular ore processing system according to claim 32 comprising a baffle for separating the overflow tank into a sludge compartment and a water overflow compartment wherein the sludge compartment is arranged to receive the overflow from the dewatering cyclone.

34. A method of mining ore in an underground mind which comprises concentrating a desired material in the ore underground in the mine with a modular ore processing system according to claim 1, prior to removing the concentrate from the mine.

35. A method according to claim 34 wherein the ore is concentrated to less than half its original volume.

36. A method according to claim 35 wherein the ore is concentrated to less than a third of its original volume.

37. A method according to claim 34 wherein waste material generated by concentration of the ore is dumped in the mine.

* * * * *

UNITED STATES PATENT AND TRADEMARK OFFICE

CERTIFICATE OF CORRECTION

PATENT NO. : 8,302,890 B2
APPLICATION NO. : 12/679999
DATED : November 6, 2012
INVENTOR(S) : Alexander Hamilton Gray-Lewis It is certified that error appears in the above-identified patent and that said Letters Patent is hereby corrected as shown below:

ON THE TITLE PAGE

At item 56, after the cited reference 5,522,510 change "Lutrell et al.", to --Luttrell et al.--.

IN THE CLAIMS

In claim 8, at column 13, line 50, after the number "8", change "A" to --The--.

Signed and Sealed this
Fifteenth Day of April, 2014

Michelle K. Lee

Michelle K. Lee
*Deputy Director of the United States Patent and Trademark Office*